US011629580B2

(12) United States Patent
Van Petegem et al.

(10) Patent No.: US 11,629,580 B2
(45) Date of Patent: Apr. 18, 2023

(54) MULTI-ZONE SINGLE TRIP COMPLETION SYSTEM

(71) Applicant: Packers Plus Energy Services, Inc., Calgary (CA)

(72) Inventors: Ronald Van Petegem, Montgomery, TX (US); John Greff, Cypress, TX (US); Kelly Ireland, Conroe, TX (US)

(73) Assignee: Packers Plus Energy Service, Inc., Calgary (CA)

( * ) Notice: Subject to any disclaimer, the term of this patent is extended or adjusted under 35 U.S.C. 154(b) by 118 days.

(21) Appl. No.: 17/390,360

(22) Filed: Jul. 30, 2021

(65) Prior Publication Data

US 2021/0381351 A1 Dec. 9, 2021

Related U.S. Application Data

(63) Continuation of application No. 16/603,443, filed as application No. PCT/CA2018/000070 on Apr. 10, 2018, now Pat. No. 11,125,060.

(60) Provisional application No. 62/483,742, filed on Apr. 10, 2017.

(51) Int. Cl.

| | |
|---|---|
| ***E21B 43/14*** | (2006.01) |
| ***E21B 33/124*** | (2006.01) |
| ***E21B 34/10*** | (2006.01) |
| ***E21B 43/04*** | (2006.01) |
| ***E21B 43/08*** | (2006.01) |

(52) U.S. Cl.

CPC ..... *E21B 43/14* (2013.01); *E21B 33/124* (2013.01); *E21B 34/10* (2013.01); *E21B 43/045* (2013.01); *E21B 43/08* (2013.01); *E21B 2200/06* (2020.05)

(58) Field of Classification Search

CPC ..... E21B 34/14; E21B 34/10; E21B 33/124; E21B 43/045; E21B 43/08; E21B 2200/06

See application file for complete search history.

(56) References Cited

U.S. PATENT DOCUMENTS

2009/0025923 A1* 1/2009 Patel ..... E21B 43/045 166/278
2017/0030173 A1* 2/2017 MacPhail ..... E21B 43/14

* cited by examiner

*Primary Examiner* — Dany E Akakpo
(74) *Attorney, Agent, or Firm* — Prince Lobel Tye LLP

(57) ABSTRACT

A multi-zone, one trip completion system for a wellbore is described. A plurality of isolation packers is installed in borehole to isolate a plurality of zones of the annulus between a tubing string and a wellbore. Each tubing string section is positioned in a zone and comprises a selectively openable stimulation port to provide stimulation fluid to its zone and a selectively openable production port to receive fluid from its zone. The system also comprises a circulation system with a plurality of circulation tubes and circulation tube valves, being configurable in a plurality of configurations to selectively connect, via a circulation flow path, the central bore or the borehole annulus of a wellbore at each of the plurality of sections, to an upper circulation flow path open to an annulus above an uppermost of the plurality of isolation packers.

18 Claims, 16 Drawing Sheets

MULTI-ZONE SINGLE TRIP COMPLETION SYSTEM

CROSS-REFERENCE TO RELATED APPLICATIONS

This application is a Continuation of application Ser. No. 16/603,443, filed on Oct. 7, 2019, which is a National Stage of International Application No. PCT/CA2018/000070, filed on Apr. 10, 2018, which claims the benefit of U.S. Provisional Application No. 62/483,742, filed on Apr. 10, 2017, the contents of which applications are hereby incorporated by reference in their entirety.

TECHNICAL FIELD

This disclosure relates to wellbore completions and production operations. Embodiments disclosed herein provide a completion system that may be installed in a single trip. Embodiments disclosed herein further provide a completion system in which multiple operations can be carried out without a service tool run from surface. More particularly, embodiments described herein include completion systems with a circulation system that facilitate various functionalities, such as gravel packing, acid stimulation, fracturing, frac packing, slurry dehydration and/or circulation without the use of service tools.

BACKGROUND

Well completions that involve multiple downhole treatments, such as a gravel pack, frac pack, acid stimulation, frac stimulation or even combinations of these, conventionally involve a number of trips into the well to install the completion tools and perform the operations. Each trip increases risk and time as well as cost.

Several technologies and systems have been developed to reduce the number of trips required to install multi-zone completion tools and perform completion operations and some of these systems have been referred to as "single trip" completions. Even though these systems are called "single trip" systems, in most cases, they are not. First, conventional "single trip" systems provide only the portion of the completion known in the industry as the "lower completion." Even if the "lower completion" is performed in a single trip, a second or even third trip are required for the "upper completion." Second, the number of zones that can be treated in one trip with conventional systems that are allegedly "single trip", is approximately five zones, while most wells have far greater than five zones, necessitating multiple trips.

Moreover, conventional, allegedly "single trip" completion systems require the use of a service tool to selectively control which zone is treated. Most commonly, the bottom zone is treated first and higher zones are treated sequentially. The service tool is connected via a work string and the service tool is then moved into various positions by moving the work string up or down from the surface. However, utilizing service tools for executing complex downhole operations, like gravel pack dehydration, is not only excessively time consuming (each service tool trip can take hours to complete), but is also prone to failure. In particular, moving the service tool around while particulate laden fluids are in and around the service tool can cause the tool to become stuck, resulting in extensive fishing or other recovery operations and additional service tool trips.

At least one lower completion system has been proposed that does not use a service tool to perform at least some completion operations. However, even these systems have several shortcomings. For example, such systems may require additional screens for dehydration and cannot take returns through the production screens during dehydration. Moreover, such systems cannot maintain zonal isolation during dehydration processes. Furthermore, while some operations may be performed without a service tool, such systems cannot maintain zonal isolation while reversing out excess slurry or fluids without intervention of a service tool. As an additional shortcoming, such systems require bull-heading the well (discussed below) when conveying a ball along the system. As yet another shortcoming, some such systems use simple check valves for production ports that do not stop pressure two ways.

SUMMARY

It should be noted that terms "upper", "back", "rear", are used to refer to a being on or closer to the surface side (upwell side) relative to a corresponding feature that is "lower", "forward", "front". For example, an "upper" end of a tubular generally refers to the feature relatively closer to the surface than a corresponding "lower" end. A feature that may be referred to as an "upper" feature relative to a "lower" feature even if the features are vertically aligned may occur, for example, in a horizontal well. Similarly, the terms Similarly, the terms "uphole", "up", "downhole" and "down" refer to the relative position or movement of various tools or objects, features, with respect to the wellhead. These terms are used similarly in horizontal wells.

Embodiments described herein provide a multi-zone completion system that can reduce the number of trips and the associated costs and risks required to install and/or operate the multi-zone systems. According to one embodiment, a multi-zone completion system comprises a circulation system having one or more circulation tubes and circulation tube valves. The circulation system is configurable to provide circulation flow paths for various fluid flows and pressure transmissions. The circulation system can provide for one or more of the following functions:

- a circulation flow path to pump an activation device such as a ball or plug into the well without the need to bull-head fluids into the formation;
- a circulation flow path to route fluids into the annulus to dehydrate a pack, such that gravel packs located downhole can be dehydrated through the dehydration tubes without using service tools;
- a dehydration circulation flow path in which circulation tubes are accessed using an activation device (e.g., ball or other activation device) to apply pressure down a central bore or annulus;
- a circulation path to reverse-out excess fluid (including slurry);
- a circulation path that maintains zonal isolation without a service tool during dehydration, reverse-out or other operations;
- stimulation without a service tool;
- dehydration without a service tool;
- reverse-out without a service tool;
- selective access to different wellbore zones to facilitate multi-zone gravel packing and completion in a single downhole trip of the completion system; and,
- activation of devices such as tubular system isolation sleeves, production sleeves and packers without a service tool.

Accordingly, the embodiments presented here are directed to a multi-zone completion assembly or system comprising a plurality of isolation packers to isolate a plurality of zones of a borehole annulus between a tubing string and a wellbore, the tubing string defining a central bore and comprising a plurality of tubing string sections. Each section is positioned adjacent to one of the plurality of zones and comprises a selectively openable stimulation port to provide stimulation fluid to its zone and a selectively openable production port to receive fluid from its zone. The completion assembly also comprises a circulation system comprising a plurality of circulation tubes and circulation tube valves, the circulation system configurable in a plurality of configurations to selectively connect, via a circulation flow path, the central bore or the borehole annulus at each of the plurality of sections, to an upper circulation flow path open to an annulus above an uppermost of the plurality of isolation packers.

Embodiments of multi-zone completion systems with circulation systems described here can provide a number of advantages, including, but not limited to the following advantages:

This multi-zone completion system minimizes over-displacement. For a conventional treatment, it can be advantageous to minimize fluids pumped into the reservoir after the treatment is performed. In conventional multi-zone completion systems, over-displacement can occur if an isolation device (e.g., ball or plug) for a zone has to be pumped down the work string without providing fluid returns to surface (this is known as "bull-heading" or "squeezing" the well). Embodiments described herein can provide an advantage by providing a circulation path for return fluids to minimize over-displacement.

This multi-zone completion system implements slurry dehydration. In case of a gravel or frac pack, there may be a need to create a tightly "packed" sand filter or proppant filter between the outside of the screen and the formation, or casing, or both. Conventionally, during dehydration, the slurry is routed through a screen that filters out the sand or proppant particles and then the filtered fluid is routed back out of the well. Completion technologies and systems have been developed, known as alternate path or shunted screens, to enhance the packing and sand/proppant placement process. However, conventional multi-zone completion systems typically require a service tool trip to perform dehydration or cannot maintain zonal isolation during dehydration. Embodiments described herein provide an advantage by providing dehydration without requiring a service tool.

This multi-zone completion system reverses out excess slurry or fluids. After a well is treated there can be excess fluids in the workstring. The conventional process is to move the service tool to a "reverse-out" position and circulate fluids out of the workstring by pumping fluids into the annulus and up the workstring. During the reverse-out process, pump pressures can be high and even exceed the frac gradient of the formation. Embodiments described herein can reverse-out excess slurry or fluids without requiring a service tool, while isolating pump pressures from the formation.

This multi-zone completion system also minimizes fluid loss. Before, during, but mostly after a treatment is performed, significant fluid loss to the formation can occur. This fluid loss can create well control issues, cause damage to the formation and can be costly. With the conventional "single trip" systems, this fluid loss is controlled by moving the service tool in a predetermined position to isolate the wellbore fluids and pressure from the formation. However, after the last zone is treated, the service tool will have to be tripped out of the well and a fluid loss device needs to be activated (most commonly a ball or flapper valve). Embodiments described herein can minimize fluid loss without requiring a service tool.

The multi-zone completion system described here isolates and selectively treats each zone. For most treatments, it is desirable that each zone be isolated and treated without pressure or fluids leaking into another zone or vice-versa. This isolation needs to be maintained throughout the treatment. With conventional "single trip" systems that deploy a service tool, isolation is commonly done via the use of isolation assemblies using ports and seals that can be positioned by moving the service tool up or down. With conventional systems that do not have a service tool, isolation is done by installing balls or plugs between zones. However, such systems cannot maintain zonal isolation during dehydration. Furthermore, zonal isolation cannot be maintained during reversing-out excess fluid or slurry without intervention. Embodiments described herein can maintain zonal isolation during dehydration and reversing out excess fluid or slurry without requiring a service tool.

This multi-zone completion system implements a live annulus. A "live" annulus allows pressure to be monitored at surface independent of friction in the wellbore tubulars. As part of a frac treatment, it is often desired to know the "net" bottom hole pressure. The net pressure is the surface pump pressure minus the friction pressure due to the fluids pumped at high rates. It can be difficult to calculate the friction pressures. Conventionally, to provide a reasonably accurate net pressure, the bottom hole treating pressure is allowed to project into the annulus. If the annulus is closed, the annulus pressure gain will be a direct reflection of the net bottom hole pressure. Another method used with conventional "single trip" systems to obtain the net bottom hole pressure is to run a pressure gauge with a surface readout down hole. Embodiments described herein can provide a fluid path to provide returns to surface through tubing-casing annulus to provide a "live" annulus.

These and other advantages of the proposed system will be apparent from the following detailed description and the accompanying drawings.

BRIEF DESCRIPTION OF THE DRAWINGS

It is to be understood that other aspects of the present invention will become readily apparent to those skilled in the art from the following detailed description, wherein various embodiments of the invention are shown and described by way of illustration. As will be realized, the invention is capable of other and different embodiments and its several details are capable of modification in various other respects, all within the present invention. Accordingly, the drawings and detailed description are to be regarded as illustrative in nature and not as restrictive.

DETAILED DESCRIPTION

This disclosure and the various features and advantageous details thereof are explained more fully with reference to the non-limiting embodiments that are illustrated in the accompanying drawings and detailed in the following description. Descriptions of well-known starting materials, processing techniques, components and equipment are omitted so as not to unnecessarily obscure the disclosure in detail. Skilled artisans should understand, however, that the detailed description and the specific examples, while disclosing preferred embodiments, are given by way of illustration only and not by way of limitation. Various substitutions, modifications, additions or rearrangements within the scope of the underlying inventive concept(s) will become apparent to those skilled in the art after reading this disclosure. Furthermore, any dimensions provided are provided by way of example and not limitation.

As indicated above, the embodiments described herein provide a multi-zone completion system that can reduce the number of trips and the associated costs and risks required to install and/or operate the multi-zone systems. According to one embodiment, this multi-zone completion system comprises a tubular system with a circulation system having one or more circulation tubes and circulation tube valves. The circulation system is configurable to provide circulation flow paths for fluid flow and pressure transmission.

FIGS. 1-13 illustrate a multi-zone completion system in various modes of operation. While FIGS. 1-13 only illustrate a two-zone implementation; embodiments may be configured to treat a large number of zones, including 28 or more zones, in a single trip. As indicated above, the multi-zone completion system 10 can take a number of configurations to allow run-in, stimulation, dehydration, reverse circulation and other operations to occur without intervention of a service tool.

Figure 1A:
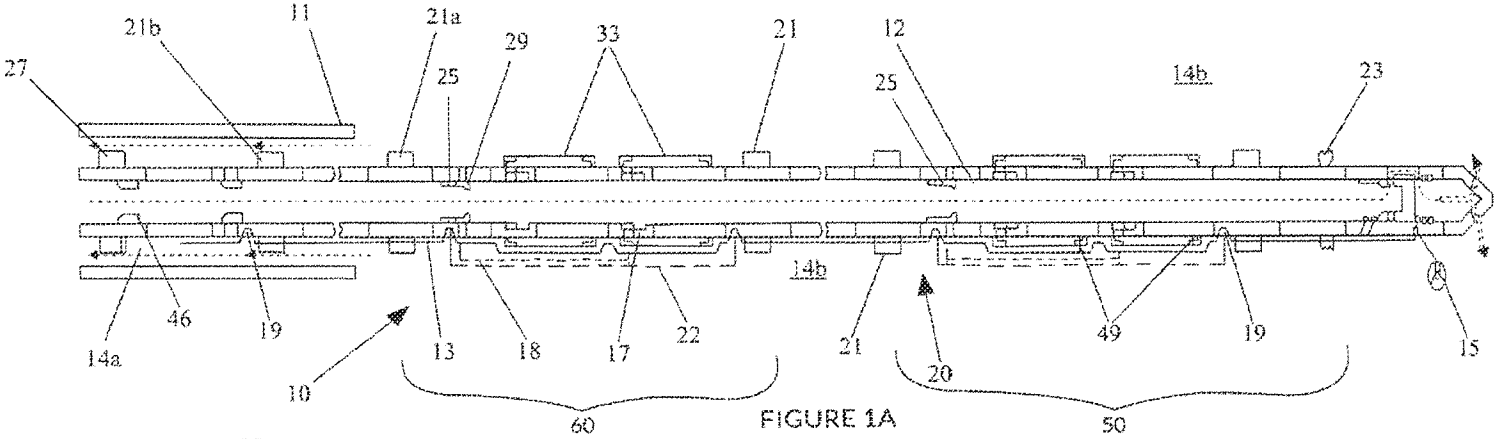
FIG. 1A illustrates an embodiment of a multi-zone completion system in the run-in stage.
Figure 1B:
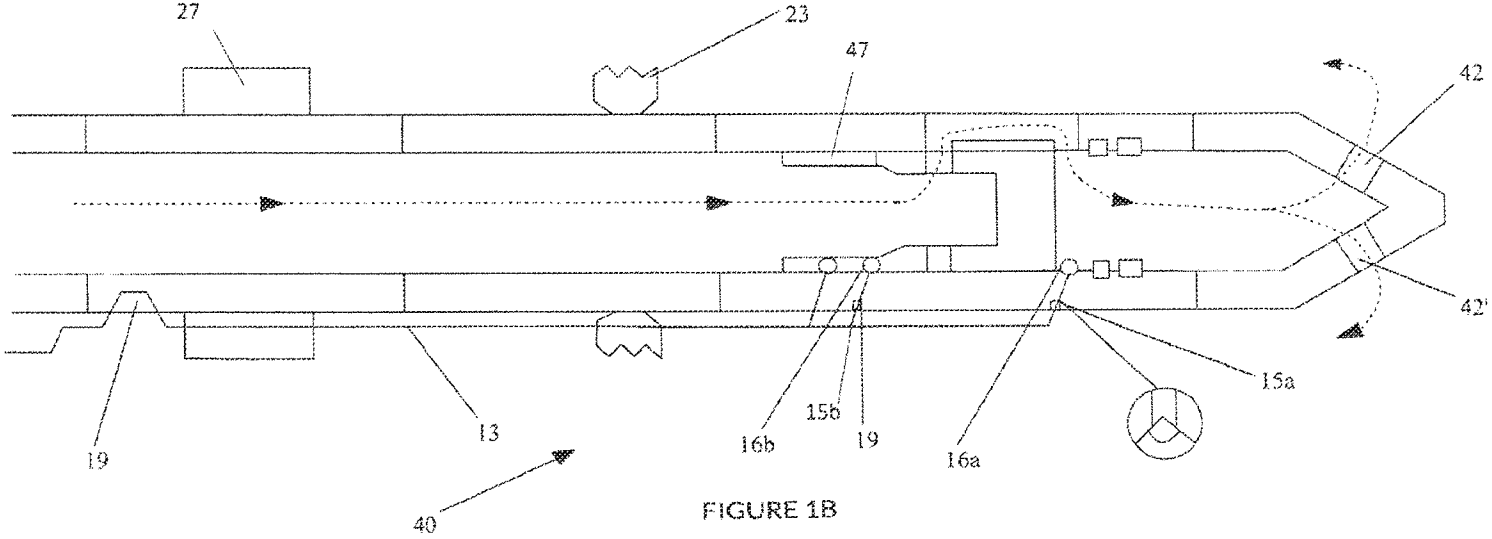
FIGS. 1B-1D show more detailed cross-sectional views of successive axial portions of the multi-zone completion system shown in FIG. 1A from the bottom of the wellbore to the top.
Figure 1C:
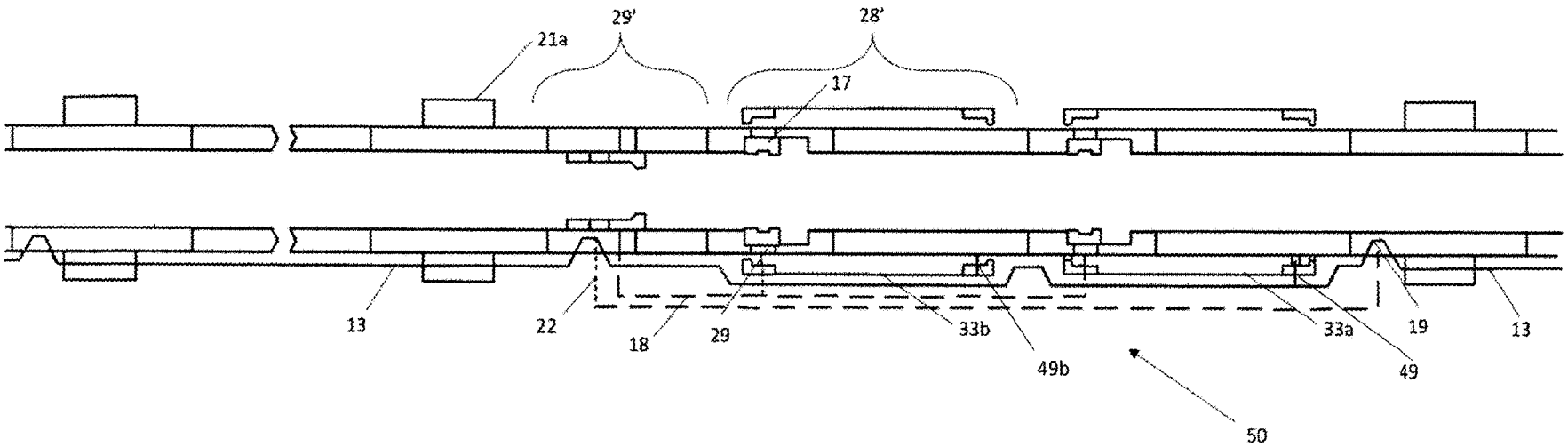
Figure 1D:
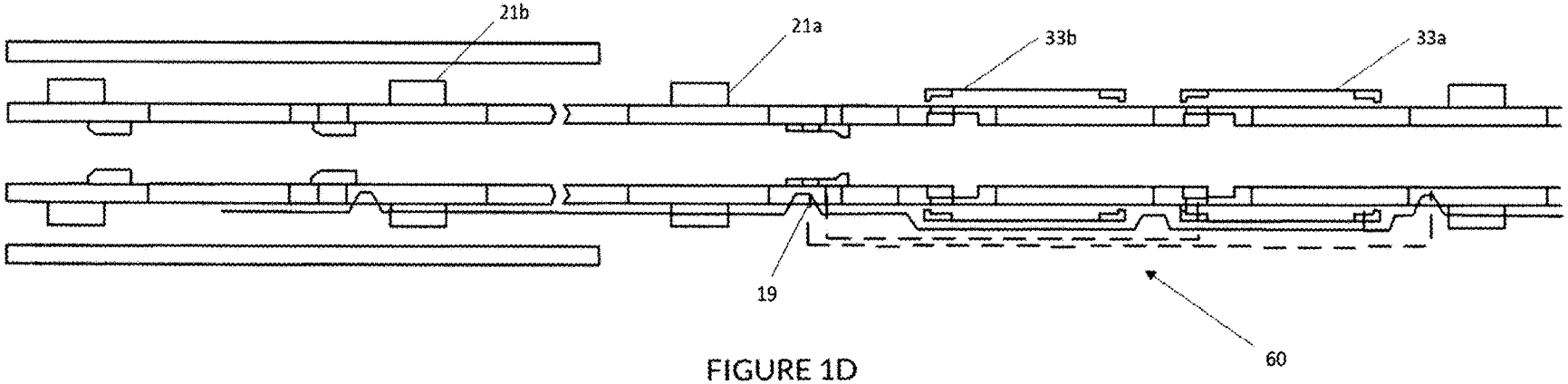

FIG. 1A illustrates an embodiment of a multi-zone completion system 10 in a run-in-hole stage, and FIGS. 1B-1D provide more detailed cross-sectional views of successive axial portions of the multi-zone completion system embodiment from the bottom of the wellbore to the top.

In FIG. 1A, the multi-zone completion system 10 is secured to the casing 11 with a liner hanger or other suitable support mechanism (not shown) and extends into an open wellbore, outside of the central bore 12. For purposes of discussion, the portion 14*a* of the annulus between multi-zone completion system 10 and the casing 11 is referred to as the "casing annulus" and the portion 14*b* of the annulus between the multi-zone completion system 10 and the open hole formation is referred to as the "borehole annulus". In other embodiments, however, the multi-zone completion system may be installed in a cased wellbore. As the skilled artisan would understand, in such an implementation, the borehole annulus 14*a* is the annulus between the multi-zone completion system 10 and the casing 11 in the production portion of the well. The following description of FIGS. 1A-D may refer to these figures collectively as FIG. 1.

The system 10 uses isolation packers 21 to isolate a plurality of zones of a borehole annulus 14; the packers 21 that are placed in the open hole zone are referred to as "open bore" packers 21*a*, and packers placed in the cased bore zone, are referred to as "cased bore" packers 21*b*. FIG. 1A also shows a plurality tubing string sections 50, 60, where each section is positioned to be adjacent to one of the plurality of zones. The attached drawings illustrate only a first section 50 at FIGS. 4B, 5B, 6B and 11A and a second section 60 at FIGS. 8A, 8B, 9A, 9B, 10A, 10B, 11A, 11B, by way of example; as indicated above a much higher number of sections, similar to the ones described here can be implemented. Also, the same reference numeral is used herein to designate both a section and the associated zone.

Each section comprises a selectively openable production port assembly 28', seen in FIG. 1C, to provide stimulation fluid to a corresponding zone, a selectively openable stimulation port assembly 29' to receive fluid from the corresponding zone, and a circulation system 20 comprising a plurality of circulation tubes 13 and circulation tube valves 15. The circulation system 20 is configurable in a plurality of configurations to selectively connect, via a respective circulation flow path, to the central bore 12 or to the wellbore annulus 14*a*, 14*b*. The circulation system may be configurable such that a lower circulation path opening may occur at various ports exposed to the central bore 12 or the borehole annulus 14*b*. According to one embodiment, the circulation system 20 may by configurable to selectively connect, via the circulation flow path, the central bore 12 or the borehole annulus 14*b* at each of the plurality of sections to the upper circulation flow path opening. The upper circulation flow path opening may be open to a portion of the annulus. Preferably, the upper opening is above the highest isolation packer set between the multi-zone completion system and wellbore or casing during completion to allow returns up the annulus and/or to provide a live annulus.

As indicated above, the circulation tubes 13 and the valves 15 are designed to form circulation paths of various configurations. The valves 15 allow communication between the central bore 12 and the circulation flow paths and between the borehole annulus 14*b* and circulation flow paths through circulation tube ports 16 provided in selected parts of the circulation system 20.

The multi-zone completion system 10 further includes circulation tube isolation sleeves/valves 19. The isolation sleeves 19 are adapted to prevent the currently treated zone from communicating with the other zones via the respective circulation tube. These sleeves are selectively configurable to isolate a certain circulation flow path from circulation tubes below the circulation tube isolation valve.

The circulation tube isolation valves/sleeves 19 can be activated by hydraulic or electric signals via a control line 22 to selectively isolate circulation tubes 13 below the isolation sleeve 19 from isolation tubes above the sleeve 19. In particular, the circulation tube isolation sleeves 19 may be positioned such that the circulation tubes 13 at and above an active zone of interest (i.e. a zone currently being treated) can be isolated from circulation tubes below the zone of interest. Thus, as illustrated in FIG. 1, a circulation tube isolation valve is incorporated in a lower isolation packer 21 for each zone of interest, to close off the circulation flow path proximate to that packer. In other embodiments, the circulation tube isolation sleeves 19 may be incorporated in other assemblies.

As such, the isolation sleeves 19 may isolate other zones from the circulation flow path when a particular stage is being completed, along with the circulation tube valves 15, which are also configurable to maintain zonal isolation during stimulation, dehydration, reverse circulation and other processes.

The production port assembly 28', provided in each section 50, 60 includes the respective production port 28 and a production sleeve 17 for each port 28, which channels the fluids during the dehydration and production steps, which with isolation sleeves/valves 19, control or regulate fluid flow across multiple zones along the length of circulation system 20. Ports 28 can be selectively opened during operation to provide fluid communication between the borehole annulus 14*b* and central bore 12 of the multi-zone completion system 10.

Each of the production port assembly 28' sliding sleeve 17 that can be opened by hydraulic or electrical control, e.g., via the production sleeve control line 18. The production port assembly 28' may also include inflow control devices (ICDs) 35, shown on FIGS. 13A-13E (collectively referred as FIG. 13), that use well screens 33, with valves to control the flow of fluid through the flow devices. In particular, each ICD 35 screens fluid communication through, for example, a flow path from the borehole annulus 14*b* to the central bore 12. At the same time, the ICDs 35 can prevent fluid communication from the central bore 12 to the borehole annulus 14*b* along this flow path. While the illustrated embodiment shows disjoint screens 33 over the production ports assembly 28', there may be a joined screen or additional joined screens per zone of interest.

Various sections of the multi-zone completion system between the isolation packers 21 include tools to stimulate a corresponding zone of interest and receive produced hydrocarbons from the corresponding zone of interest. A stimulation port assembly 29' also referred to as a "stimport" assembly, includes a stimulation port 29 and a stimulation port sleeve 25, shown e.g. in FIG. 1A. The stimulation ports 29 can be selectively opened and closed during operation to provide or prevent fluid communication between the central bore 12 of the multi-zone completion system 10 and the borehole annulus 14*b*. Namely, sliding sleeve 25 (e.g., a frac sleeve) can be opened by using frac plugs, balls or other activation device deployed downhole during frac operations. As treatment is performed in the well, these dropped plugs or balls selectively open the stimulation port assemblies 29' and isolate lower sections of the central bore 12 so that the assemblies 29' can successively divert frac treatment to adjacent zones of interest up the multi-zone completion system 10. Preferably, the stimulation port assemblies 29' are each located adjacent to a zone of interest defined by the isolation FT packers 27 or other isolation devices.

In the multi-zone completion system 10, the isolation packers 21 are "feed-through" or "FT" packer assemblies. For purposes of this disclosure, "feed-through" refers to assemblies that have the capability to allow circulation fluid to pass through the isolation FT packer without breaking zonal isolation. These packer assemblies have a mechanism to route the fluids from the circulation system 20 through the packer. In some implementations, these packers 21 can also function as the production packers.

The multi-zone completion system 10 may include one or more cased hole isolation packers 21*b*. The cased hole packers 21*b* function as the top anchoring point during the treatments.

Open hole isolation FT packers 21*a* include slip assemblies and seals (not shown) as well as other devices that are known to those skilled in the art for providing a sealing and gripping relationship between the multi-zone completion system 10 and the central bore 12. Additionally, the isolation FT open hole packer 21*a* may be any type of packer, such as mechanically set, hydraulically set or hydrostatically set packers as well as a swellable packer, for example.

In FIG. 1B, the isolation FT packers 21 are open hole FT packers 21*a*. The open hole isolation FT packer 21*a* may activate responsive to pressure applied to the annulus, pressure applied to the central bore 12, or a differential pressure between the annulus and central bore 12 or other signal.

Similarly, the isolation FT packers 21 may be set between in a cased hole in cased wells. As the open hole FT packers, the cased hole packers 21*b*, can be the isolation FT packers or production packers, and they could be mechanically set, hydraulically set or hydrostatically set packers as well as a swellable packer, for example. The packers 21 can be set based on a pressure signal, for example responsive to pressure applied to the annulus, pressure applied to the central bore 12, or a differential pressure between the annulus and central bore 12 or other signals.

The multi-zone completion system 10 may also include one or more FT anchor packers 23, as shown in FIG. 1B for example, which can be also referred to as a "feed-through anchors" or "FT anchors". These anchor packers provide a mechanism to "anchor" the system to the formation and help prevent relative movement between the isolation FT packers 21 and casing 11 or open hole, due for example to contraction. An FT anchor packer 23 includes one or more circulation tubes to route circulation flow from above or below the FT anchor packer through the FT anchor packer. The anchor packers 23 may be set selectively after all treatments are completed. The FT anchor packer 23 includes slip assemblies or other devices that are known to those skilled in the art for providing a gripping relationship between the multi-zone completion system 10 and the open hole, or casing in a cased hole implementation. The FT anchor packer 23 can be settable based on a pressure signal, for example responsive to pressure applied to the annulus, pressure applied to the central bore 12, or a differential pressure between the annulus and central bore 12 or other signals. In some implementations, this packer can also function as the production packer 23.

FIG. 1 also shows production packers 27. A production packer 27 could have a feed through system and may activate responsive to pressure applied to the annulus, pressure applied to the central bore 12, or a differential pressure between the annulus and central bore 12 or other signal. A production packer 27 includes slip assemblies and seals as well as other devices that are known to those skilled in the art for providing a sealing and gripping relationship between the multi-zone completion system and the casing. Additionally, the production packer 27 may be any type of packer, such as mechanically set, hydraulically set or hydrostatically set packers as well as a swellable packer, for example. Various pieces of completion equipment (not shown) may be located above the production packer including, but not limited to a tubing retrievable safety valve, down hole pressure gauge, chemical injection mandrel, gaslift mandrels, and other components.

Preferably, the multi-zone completion system 10 may also include hydraulic and or electrical systems not shown on FIG. 1A. The hydraulic control enables measurements and controls such as, but not limited to pressures and temperatures. The electrical system can include wireless telemetry systems and down hole power generators.

The multi-zone completion system 10 may include one or more inflow and outflow control devices (ICD's/OCD's), shown on FIGS. 13, to reduce or prevent cross flow between zones and/or to distribute inflow or outflow rates.

According to one embodiment, the tubular system includes a feature that allows the circulation tubes to fill automatically with wellbore fluid as they are run into the wellbore.

The multi-zone single trip completion system 10 can be installed in cased holes or open holes without any planned service tool intervention. Still further, one embodiment of a multi-zone single trip completion system 10 can combine both lower and upper completion in a single trip.

Figure 2A:
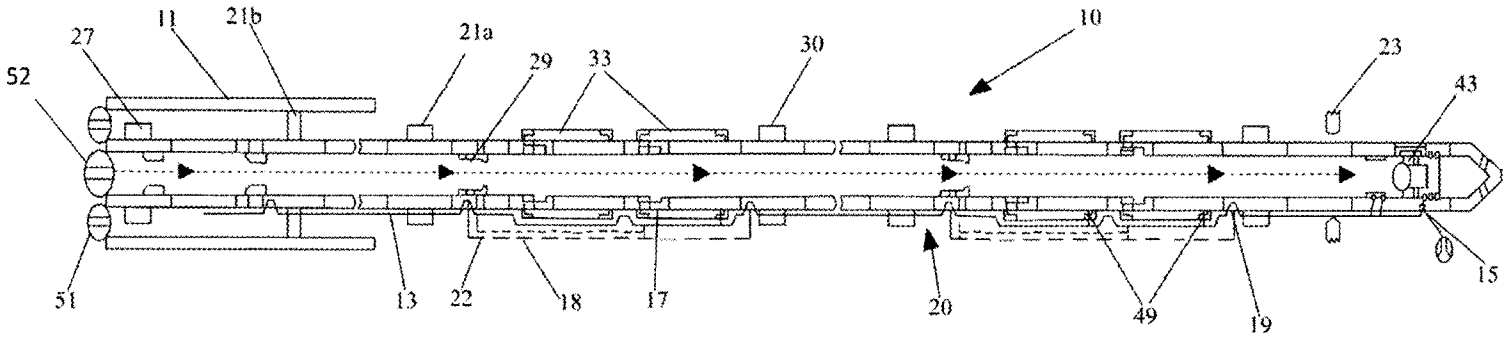
FIGS. 2A and 2B show activation of the shift sleeve of the toe system.
Figure 2B:
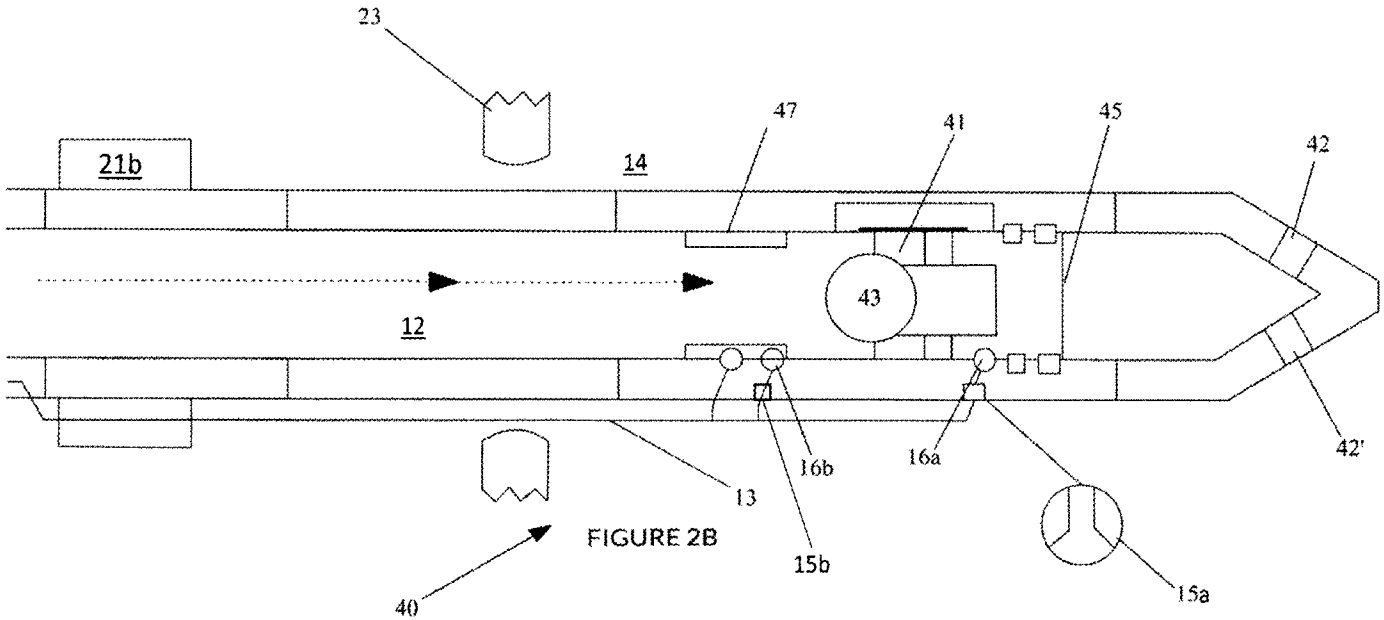

During run in, fluid can be circulated through the central bore 12, out the toe circulation ports 42, 42' and up the borehole annulus 14*b*. At its downhole end, shown in some details on FIG. 1B, the multi-zone completion system 10 includes the toe circulation assembly 40, such as a shoe track assembly, that facilitates run in of the multi-zone completion system 10. Assembly 40 allows for setting of one or more optional anchors 23 and one or more packers 21, 27. The toe circulation assembly 40 has a bottom toe shift sleeve 45 with a seat 41 for engaging a setting device 43 (e.g., ball or plug), as shown in FIG. 2B, for activating the shift sleeve 45 that shifts to isolate toe circulation ports 42, 42'. The assembly 40 also uses a toe check sleeve 47.

The toe circulation assembly 40 includes one or more circulation tubes 13 and circulation tube valves 15*a*, 15*b* to provide a toe circulation assembly circulation flow path that can be selectively connected to the central bore 12 via a plurality of circulation ports 16. The circulation tube valves 15*a*, 15*b*, also referred to as check valves, selectively allow flow through the circulation ports 16 from the central bore 12 to the circulation tubes 13. In the embodiment illustrated, the shift sleeve 45 of the toe circulation assembly 40 shifts responsive to pressure signals, such as for example responsive to pressure applied to the annulus, pressure applied to the central bore 12, a differential pressure between the annulus and central bore 12 or other signals. The shift sleeve 45 and check sleeve 47, as discussed in more detail below, can be selectively movable to cover or expose circulation ports 16.

By setting the valves 15 and sleeves 17, 19 and 25, the circulation system 20 can assume, as indicated above, a plurality of fluid path configurations. Thus, the system can provide a direct path circulation configuration, when the fluid circulates down the central bore 12 and up an annulus/circulation path provided by the circulation system, or a reverse path circulation configuration, when the fluid circulates down an annulus/circulation path and up the central bore 12.

FIG. 1C illustrates the first section 50 shown in FIG. 1A, enlarged. As seen, the circulation system 20 can provide a circulation system dehydration flow path, during the dehydration process, which removes the extra fluid from the gravel slurry. Thus, post fracking, the gravel slurry is sent downhole from the wellbore surface. The slurry is routed through a screen 33 and the gravel particles are collected e.g. near the separation between the zones. As the sand and/or proppant are filtered out by the screen 33, the extra fluid is removed using a circulation (dehydration) tube from the circulation system. The removal of the extra fluid allows the gravel to be "packed" and facilitates control by filtering the produced fluid during the production stage. This dehydration configuration can have a sequencing valve system that aids the dehydration process by creating a pressure drop that favours dehydration occurring from the bottom up and limits bridging of a pack.

FIG. 1C also shows a production sleeve 17, controllable through control line 18 to configure the flow paths that open or close corresponding/associated production port 28, which selectively connects the flow path to the borehole annulus 14*b* via one or more circulation ports 16. As seen, the circulation system 20 include circulation tubes 13 and check valves 15, which may be configured as a circulation system production flow path during production process.

The production port assembly 28' may also include dehydration valves 49*a*, 49*b* that selectively open to route fluid that passes through the screen 33 into the circulation tubes 13. A dehydration valve 49 used during the dehydration process, may have a releasable setting mechanism, such as one or more shear pins, that holds the dehydration valve closed against pressure from the annulus until a force on the dehydration valve overcomes the holding force of the releasable setting mechanism. Thus, the dehydration valve 49 may be held closed until certain conditions are met. Each dehydration valve 49 may be a check valve that allows fluid to flow into the circulation tubes 13 but does not allow flow out of the circulation tube 13 through the valve 49 and into the screen 33. Furthermore, the dehydration assembly circulation flow path can be selectively connected to circulation flow paths from sections above or below that production assembly. For example, a circulation tube isolation sleeve can be activated to selectively isolate the production assembly circulation flow path from circulation tubes 13 of a downhole section.

The stimulation port assembly 29' includes one or more circulation tubes 13 and one or more circulation tube valves 15 to provide a circulation system stimulation flow path that can be selectively connected to the central bore 12 via one or more circulation ports 16. The circulation tube isolation valves 19 selectively allow flow through a circulation ports 16 from the central bore 12 to the circulation system stimulation flow path. The circulation tube isolation sleeve 19 shifts to isolate a stimulation port assembly circulation tube 13 from a downhole circulation tube 13 and open a circulation port to allow flow between the central bore 12 and the upper stimulation port assembly circulation tube. In one embodiment, the frac sleeve of assembly 29' may be coupled to or act as a circulation tube valve to selectively isolate the upper circulation tube 13 from the lower circulation tube 13 or to selectively expose a circulation tube to allow between the central bore 12 and a circulation tube.

The first section 50 shown in FIG. 1C further includes an (FT) open hole isolation packer 21*a* which may be a packer without an isolation sleeve, while the downhole packer may be a packer without an isolation sleeve.

FIG. 1D illustrates an enlarged view of the second section 60 of the multi-zone single trip completion system 10. The section includes many similar devices and assemblies such as the first section 50. In addition, FIG. 1D shows a cased hole isolation FT packer 21*b* without an isolation sleeve 19. As indicated above, a cased hole packer typically functions as the top anchoring and isolation point during the treatments. Being a feed-through cased hole packer, packer 21*b* has a mechanism to route fluids into the tubular system besides the mechanism to "anchor" the system to the casing, which helps prevent movement of the multi-zone completion system. As indicated above, packer 21*b* includes slip assemblies or other devices that are known to those skilled in the art for providing a gripping relationship between the multi-zone completion system 10 and the open hole, or casing in a cased hole implementation.

The multi-zone completion system may include one or more blanks that simply enable the central bore 12 and circulation path to connect to sections above and below the blank. As would be understood to those in the art, a blank may be joint of pipe without any screen that is used to achieve spacing between zones or additional room that acts as a buffer in the event that sand settles proximate to the screen. For example, one or more blanks can be located between a port and a screen.

Also, the multi-zone completion system 10 may include additional or alternative tools to those illustrated. Although not illustrated in FIG. 1, FIG. 2A illustrates that a surface annulus valve 51, (such as a choke line) and central bore valve 52 may be used to open or close the first portion of the annulus (e.g., the portion of the annulus that is not isolated from surface by a packer during completion operations, such as the casing annulus above the FT cased hole packer).

As mentioned above, the circulation system 20 is configurable in a plurality of configurations. The plurality of configurations may include one or more of:

a running-in flow path configuration in which the circulation flow path provides for circulation of fluid to allow an activation device to be pumped down a central bore 12 without bull-heading fluids into the annulus;

- a dehydration flow path configuration in which the circulation flow path provides a dehydration flow path for dehydrating a gravel pack without using service tools;
- a reverse flow path configuration whereby the excess fluid is extracted without using service tools;
- a stimulation flow path configuration that enables treatments such as fracking and a live annulus.

Each of the plurality of configurations can further maintain zonal isolation between an active zone and other zones.

In FIGS. 2A-2B, collectively "FIG. 2", a ball, plug or other setting device 43 is conveyed down the central bore 12 of the multi-zone completion system 10 to land on and seal with the bottom seat 41. Pressure applied to the central bore 12 results in a pressure differential across the seated activation device that causes the shift sleeve 45 to shift. The shifted sleeve covers a first check (circulation) valve 15*a* and isolates the toe circulation ports 42, 42' from the portion of the central bore 12 above the seat 41. Additional pressure can be applied to the central bore 12 to pressure test the multi-zone completion system. The anchor packer 23 is set, as well as the cased hole packer 21*b*.

Figure 3A:
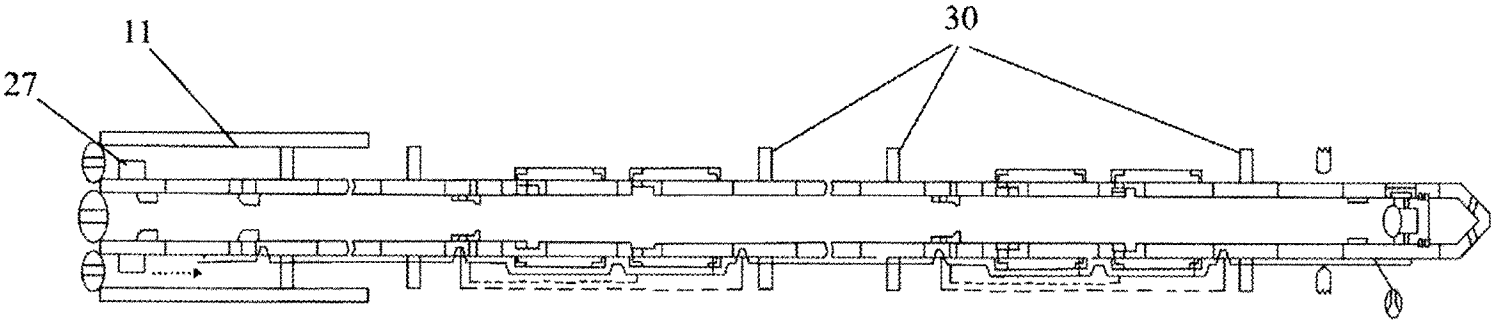
FIGS. 3A and 3B illustrate setting of the "feed-through" (FT) packers and configuring a circulation flow path isolated from the central bore and borehole annulus.
Figure 3B:
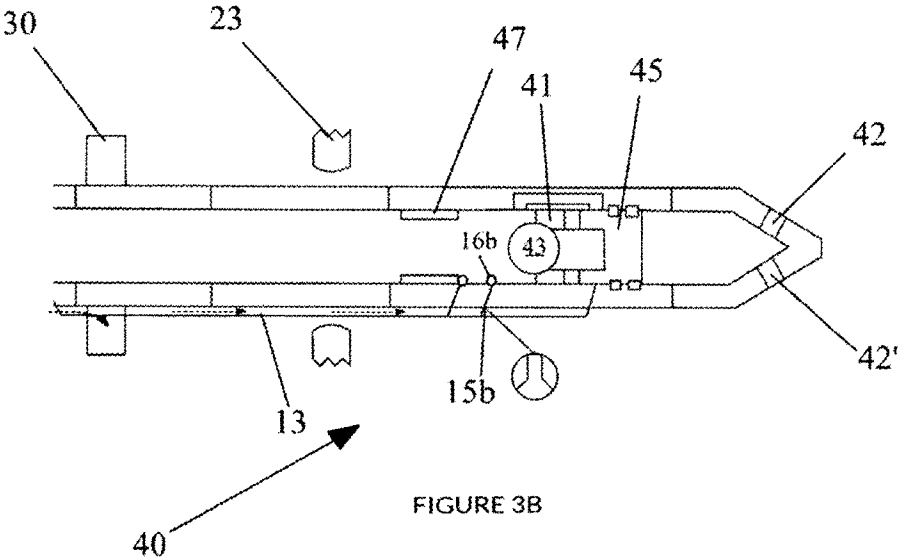

In FIGS. 3A-3B, collectively "FIG. 3", pressure is applied down the annulus to set the open hole FT packers assemblies 30 (set packers are shown us upright rectangles, while unset packers are shown as horizontal rectangles) and pressure test the annulus 14*b*. Furthermore, the check sleeve 47 shifts responsive to pressure applied to the annulus 14*b* to expose a second check valve 15*b*, between the central bore 12 and circulation system 20. At this point, a circulation flow path is open to flow from the central bore 12 through the second check valve 15*b* to provide a flow path from the second circulation tube port 16*b* to the casing annulus above the FT cased hole packer. The circulation tube valves are configured such that the circulation flow path is otherwise isolated from the central bore 12 and borehole annulus 14.

Figure 4A:
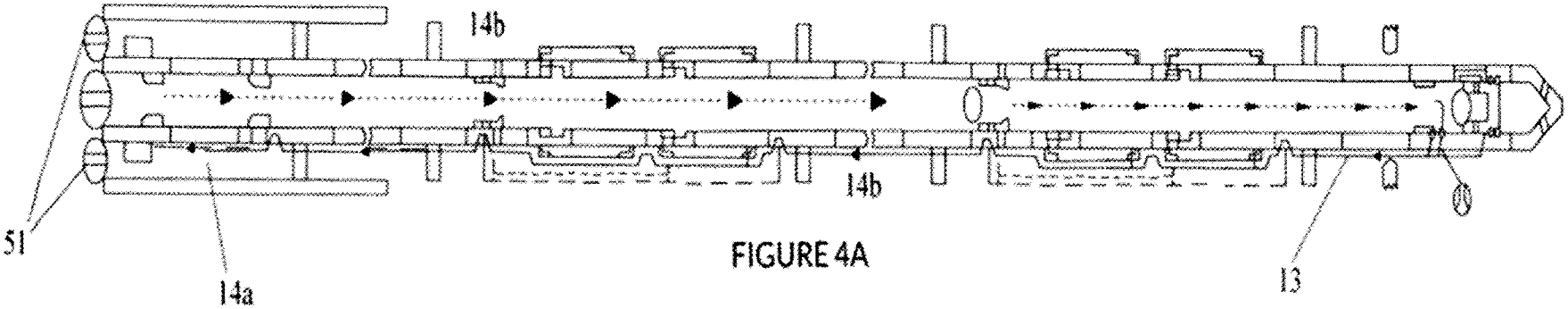
FIGS. 4A and 4B show opening of a stimulation port of the first section of the multi-stage single trip completion system.
Figure 4B:
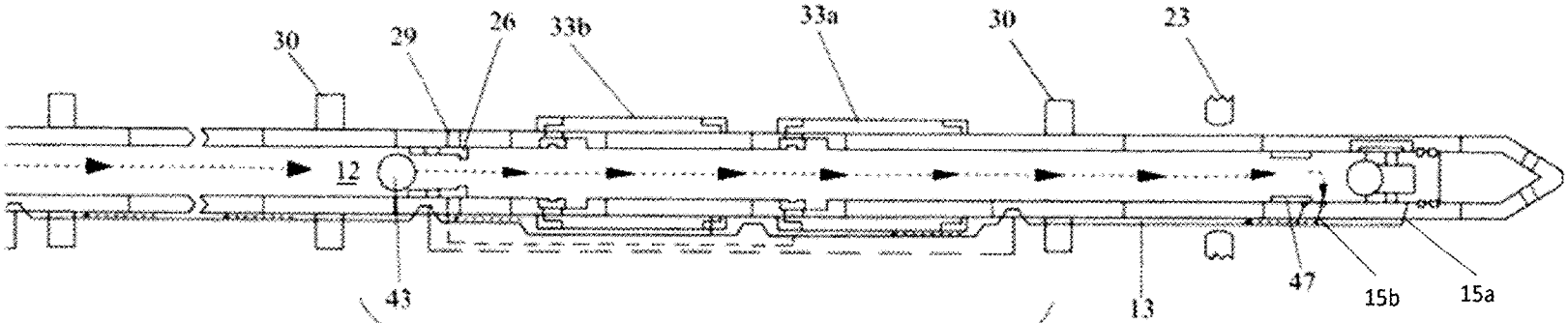

With reference to FIGS. 4A-4B, collectively "FIG. 4", a ball, plug or other activation device 43 is conveyed to the stim port seat 26 for a zone of interest, which is the first section 50 in this FIG. It is to be noted that the balls are all denoted with 43 for simplification. Because the second check valve 15*b* can allow flow from the central bore 12 to circulation flow path from a point below the stimport seat 26, and above the bottom seat 41, fluid returns can circulate back up the multi-zone completion system to the casing annulus 14*a* using the circulation flow path and then return up to surface. Thus, unlike conventional systems that bull-head the well when conveying a ball, the multi-zone completion system of the present disclosure "circulates" the ball to the seat. That is, the ball is conveyed to the stimport seat 26 while returns are taken up the annulus.

Figure 5A:
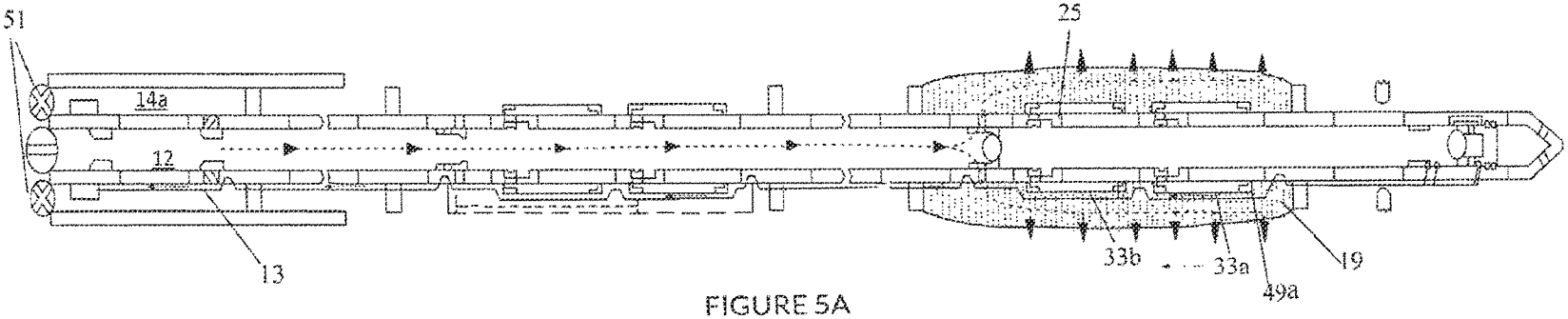
FIGS. 5A and 5B illustrate an embodiment of a stimulation configuration.
Figure 5B:
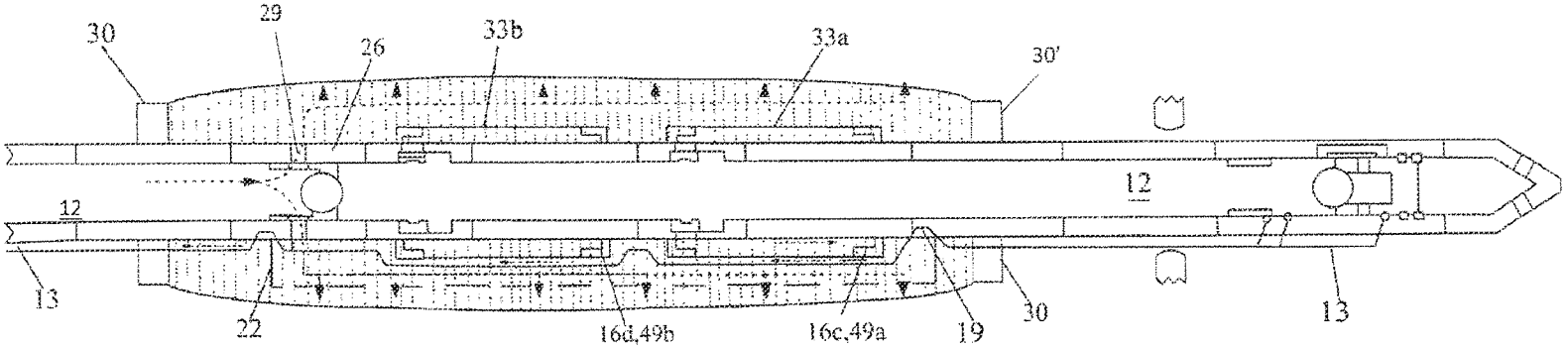

As illustrated in FIGS. 5A and 5B, collectively "FIG. 5", a ball 43 or other activation device can land on and seal with the stim port seat 26. Pressure applied down the central bore 12 can result in a pressure differential across the seated activation device that is sufficient to shift the stim port seat 26 and thereby open the stimulation port 29 for the zone of interest. In addition, pressure can be applied to the annulus such that a hydraulic signal can be conveyed via circulation tube isolation sleeve control line 22 to the circulation tube isolation sleeve 19. The circulation tube isolation sleeve 19 shifts in response to the signal to isolate the circulation flow path from the lower circulation tubes 13. The annulus valves 51 can then be closed as illustrated in FIG. 5, to create a live annulus. At this point, the circulation flow path is only open at the upper end.

Stimulation fluid is pumped down the central bore 12 and flows out of the stimulation ports 29 above the seated activation device 43 to stimulate the zone of interest, as shown by the dotted line in FIG. 5. At this time, one or more of the dehydration valves 49 at the active zone can open and, as such, pressure may go through the screens, through the dehydration valves 49 and up the circulation tubes to the casing annulus 14*a*.

The dehydration valves 49 of a production port assembly 28' may be progressive dehydration valves, meaning that the dehydration valves are configured to open under different conditions. According to one embodiment, the lower dehydration valve 49*a* can be configured to open at a lower pressure (and hence earlier) than an upper dehydration valve 49*b* in the same section. For example, the upper dehydration valve 49*b* of FIG. 5 may not open until the lower screen 33*a* is fully packed (dehydration of the lower portion of the gravel pack occurs as discussed in conjunction with FIG. 6).

In this example, with the lower dehydration valve 49*a* open, the circulation path thus runs from the third circulation tube port 16*c* to the casing annulus 14*a*, but is otherwise isolated from the central bore 12 and borehole annulus 14*b*, as shown in FIG. B. Thus, the only openings to the circulation flow path are at the casing annulus 14*a* (above the FT cased hole packer assembly 30), and at the zone of interest between the two isolation packers assemblies 30, 30' that isolate the zone of interest. If the annulus valve 51 is closed as illustrated in FIG. 6, which may occur after the circulation tube isolation sleeve 19 is shifted, pressure can build in the annulus 14*a* above the cased hole FT packer 21*b* to provide a live annulus having a pressure corresponding to the pressure at the active zone of interest. A pressure gauge can be used to read the pressure in the live annulus, which will be related to the pressure in the active zone.

Figure 6A:
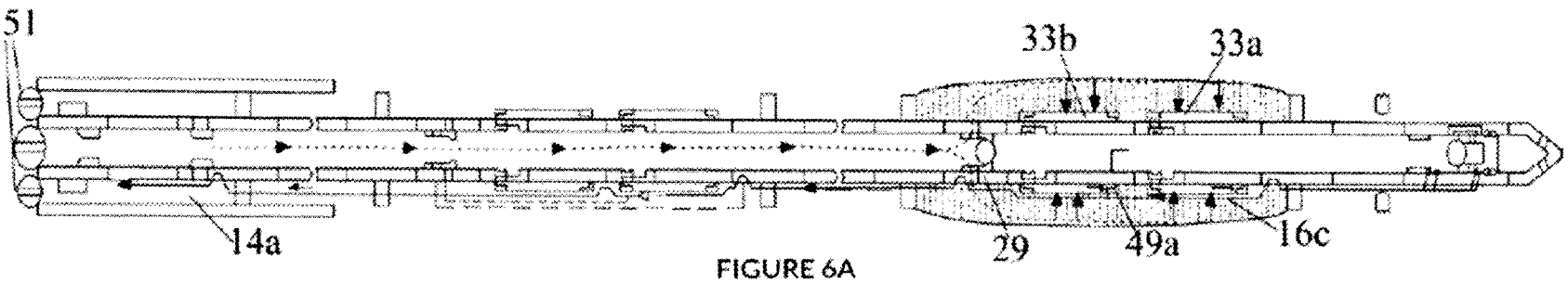
FIGS. 6A and 6B show an embodiment of a dehydration configuration.
Figure 6B:
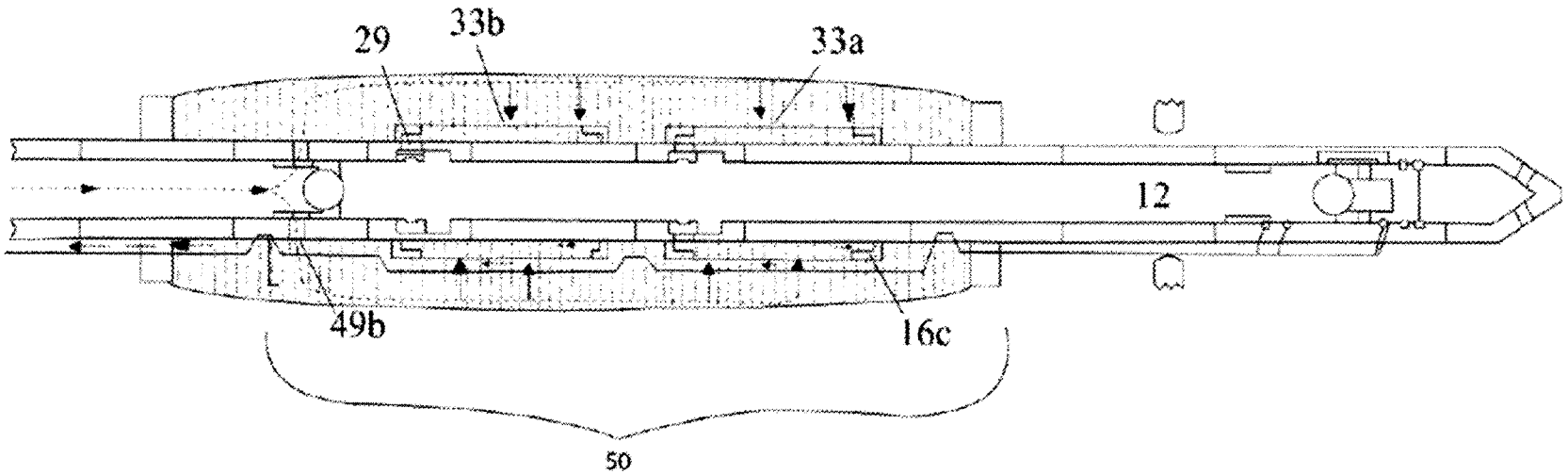

With reference to FIGS. 6A and 6B, collectively "FIG. 6", one embodiment of a dehydration configuration is illustrated. In the dehydration phase, pressure can be applied down the central bore 12 and flows into the frac pack/gravel pack via the open stimulation ports. Gravel particles collect near the ICD while extra fluid is released from the gravel.

The fluid flows into the circulation tube through the dehydration valve and up to the casing annulus via the circulation flow path. Because the annulus valve is open, the fluid can be returned to surface via the annulus. This removal of extra fluid allows the gravel to be 'packed,' which facilitates sand control by filtering the produced fluid during the production stage.

As discussed above, the upper dehydration valve 49*b* of FIG. 7 may be configured to open when the lower screen 33*a* is fully packed. The valves can be so configured, for example, by selecting shear pins or other releasable setting mechanisms with appropriate holding forces for each valve. The progressive dehydration valves force the system to dehydrate from the bottom to the top minimizing the chance of creating a void below a prematurely dehydrated section.

Figure 7A:
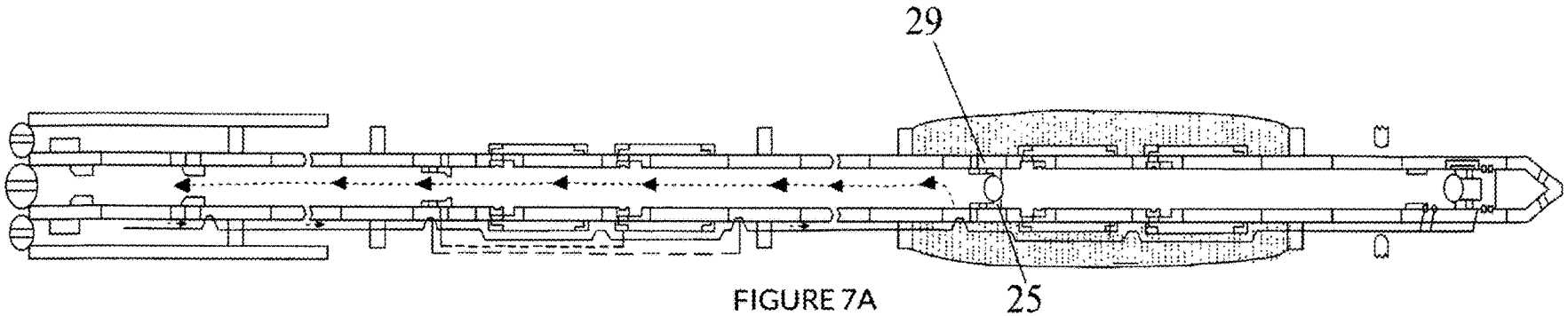
FIGS. 7A and 7B illustrates an embodiment of a reverse-out configuration.
Figure 7B:
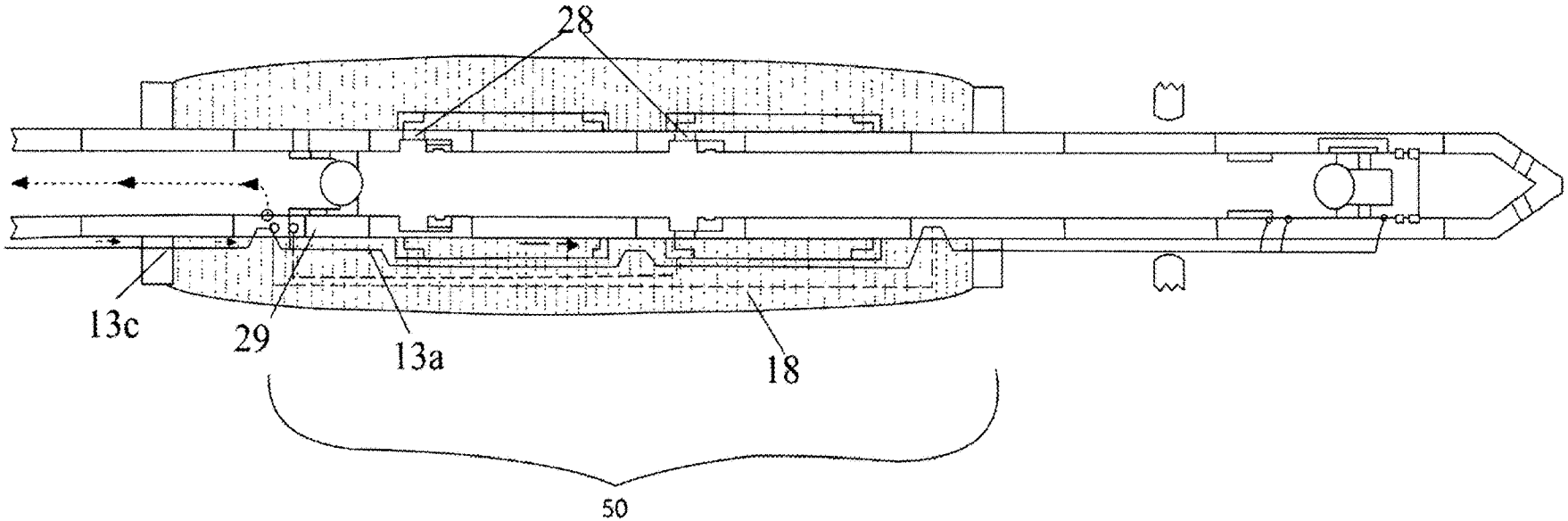

With reference to FIGS. 7A and 7B, collectively referred to as "FIG. 7", one embodiment of a reverse-out configuration is illustrated. For example, the reverse circulation configuration helps recovering from screen-out or other conditions by flushing excess sand out from the wellbore. When in reverse-out mode, the pressures associated with this process can be isolated from the formation.

In the reverse-out phase, the stimulation ports 29 are closed. Pressure can be applied down the annulus 14*b* to cause the stimport frac sleeve 25 to shift further down. It can be noted that in such an embodiment, the stimport frac sleeve 15 shifts downward to both open and close the stimulation ports.

As the stimport frac sleeve 25 shifts down, the stimulation assembly upper circulation tube 13*c* is isolated from the stimulation assembly lower circulation tube 13*a*, thus isolating the circulation flow path from lower circulation tubes. Moreover, shifting the stimport frac sleeve 25 can expose a fifth circulation tube port 16*e* and opens a production sleeve 17 such that the pressure applied to the central bore 12 or annulus can trigger the production sleeve 17 to open. In the configuration of FIG. 8, the circulation flow path runs from a fifth circulation tube port 16*e* to the casing annulus 14*a*.

As illustrated in FIG. 7, pressure can be applied down the annulus such that fluid flows down the circulation flow path and into the central bore 12 above the seated activation device 43. Reverse circulation helps to recover from screen-out conditions by flushing excess sand out from the wellbore. It can be noted that, because the open production ports are below the seal created by the ball 43 and the stimulation ports and production ports above the ball are sealed, the formation is protected from pump pressure used to circulate fluid in the reverse-out operation.

A similar procedure as discussed above in conjunction with FIG. 4-5 can be repeated for the next section. The same circulation path that was used for reverse-out of the first section 50 can be used for circulating an activation device to the second section 60.

Figure 8A:
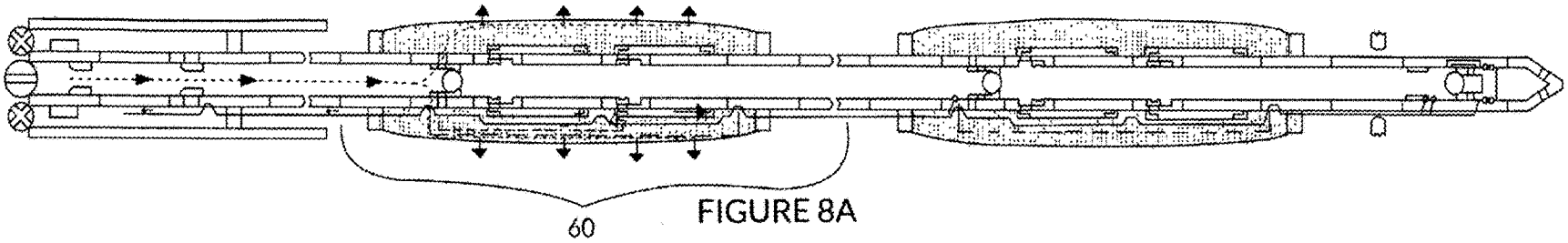
FIGS. 8A and 8B show stimulation of the second section of the multi-stage single trip completion system.
Figure 8B:
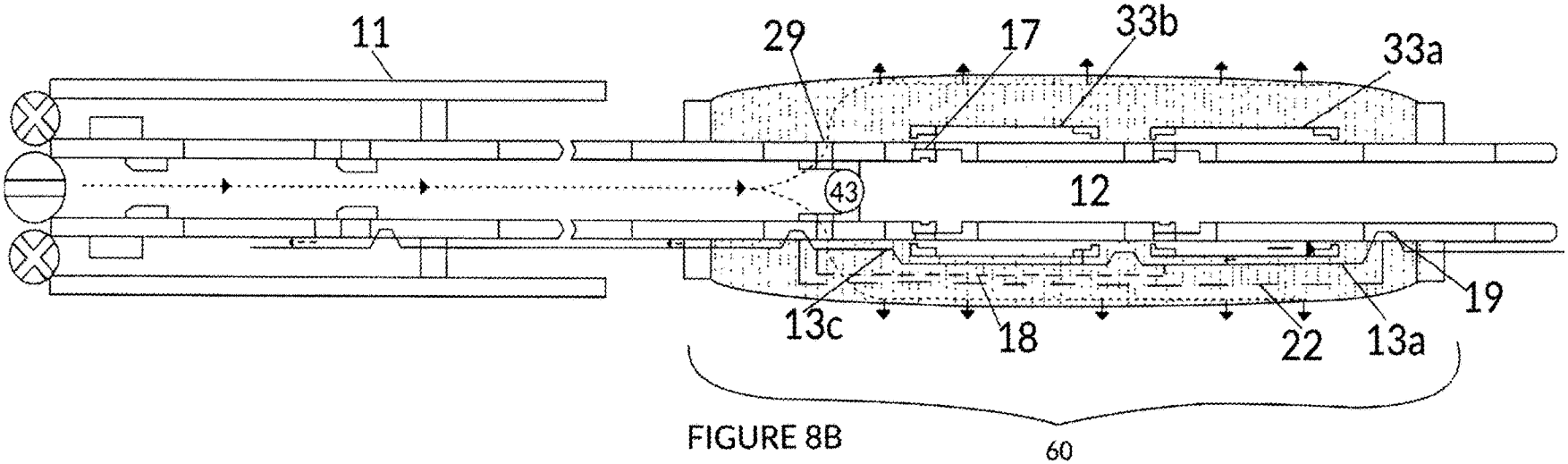

FIGS. 8A and 8B, collectively "FIG. 8", illustrate stimulation of the second section 60. It can be noted that, during stimulation, the circulation flow path can be isolated from the circulation tubes of the first section 50 by the circulation tube isolation sleeve 19.

Figure 9A:
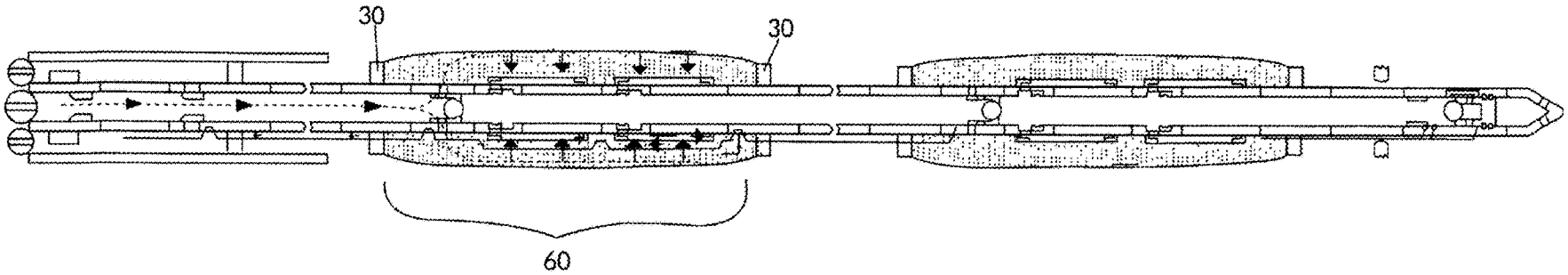
FIGS. 9A and 9B show an embodiment of a dehydration phase for the new zone of interest.
Figure 9B:
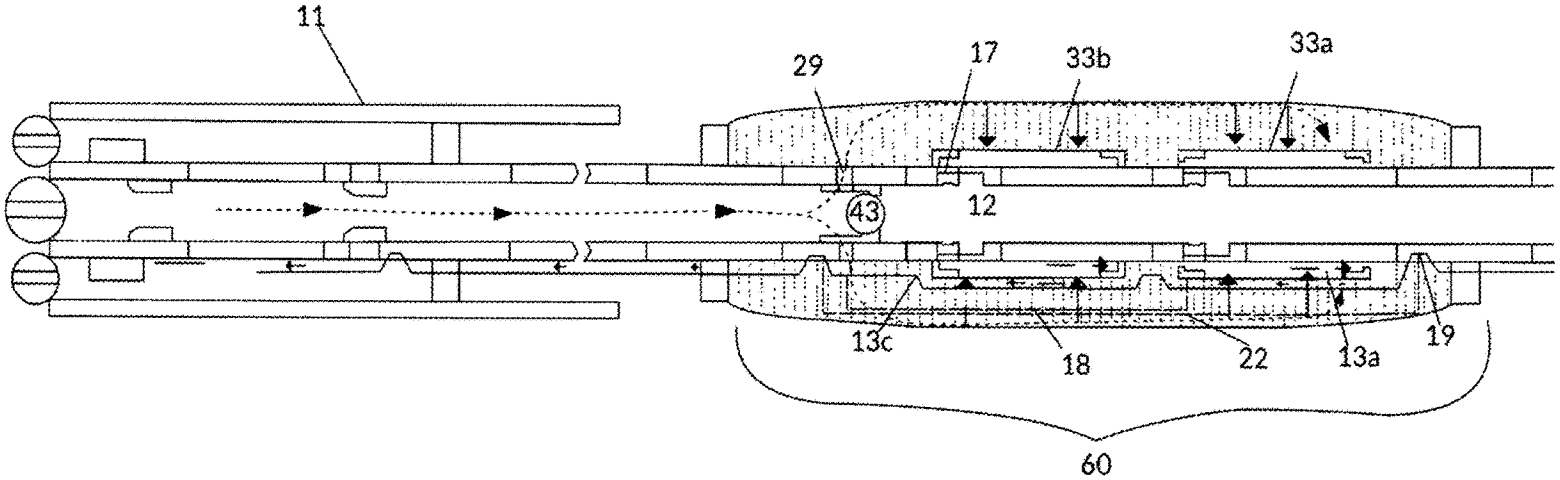

The second section 60 may also be dehydrated and reversed-out. FIGS. 9A and 9B, collectively "FIG. 9", illustrate one embodiment of a dehydration phase for the new zone of interest. Again, during stimulation and dehydration, the circulation flow path is only open at the casing annulus 14*a* (above the FT cased hole packer 21*b*) and between the two isolation packers that isolate the zone of interest through the dehydration valve(s). Thus, during treatments, other zones of interest are isolated from the active zone of interest.

Figure 10A:
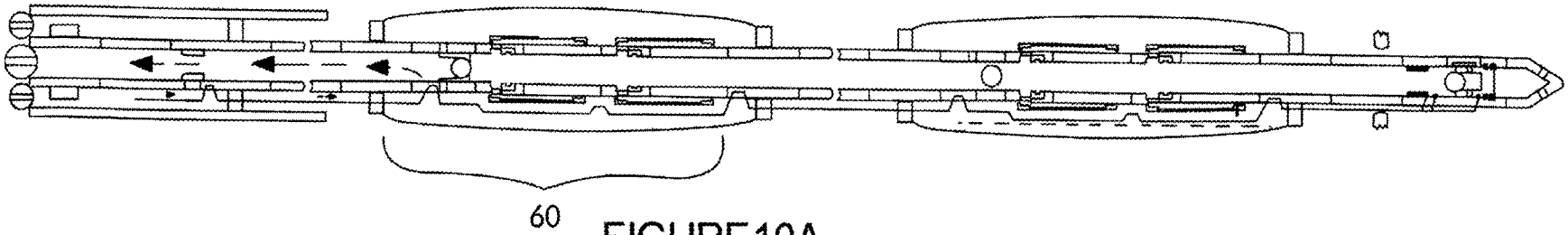
FIGS. 10A and 10B illustrate an embodiment of a reverse-out phase for the second section.
Figure 10B:
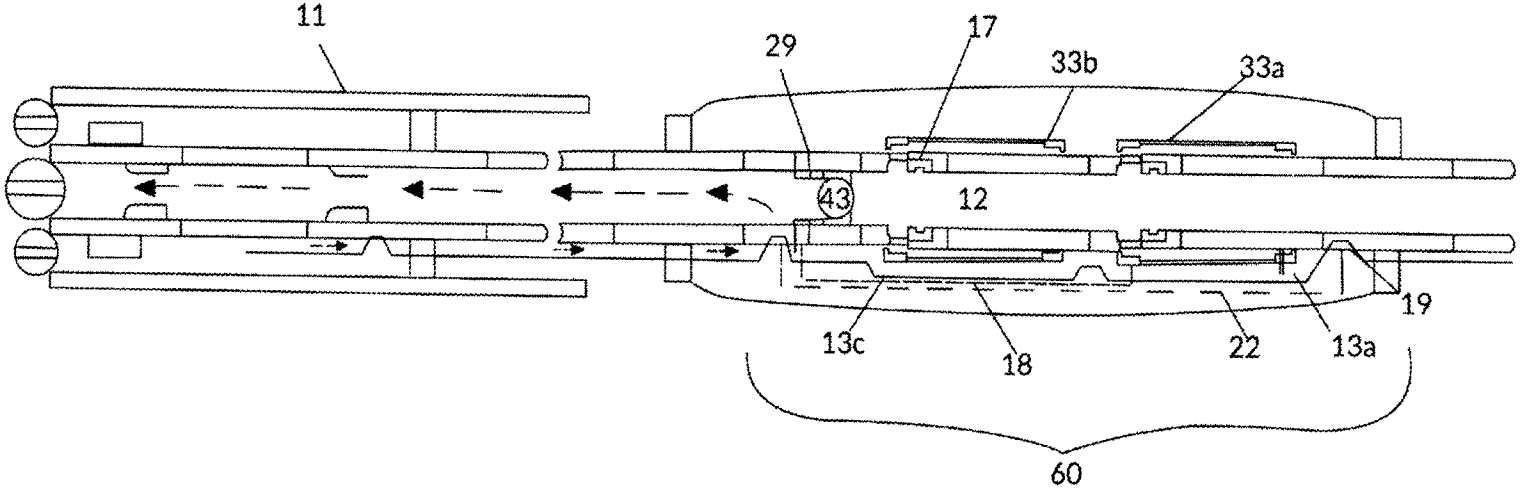

FIGS. 10A and 10B, collectively "FIG. 10", illustrate one embodiment of a reverse-out phase for the second section 60. The steps of FIGS. 7-9 can be repeated for each additional zone of interest.

Figure 11A:
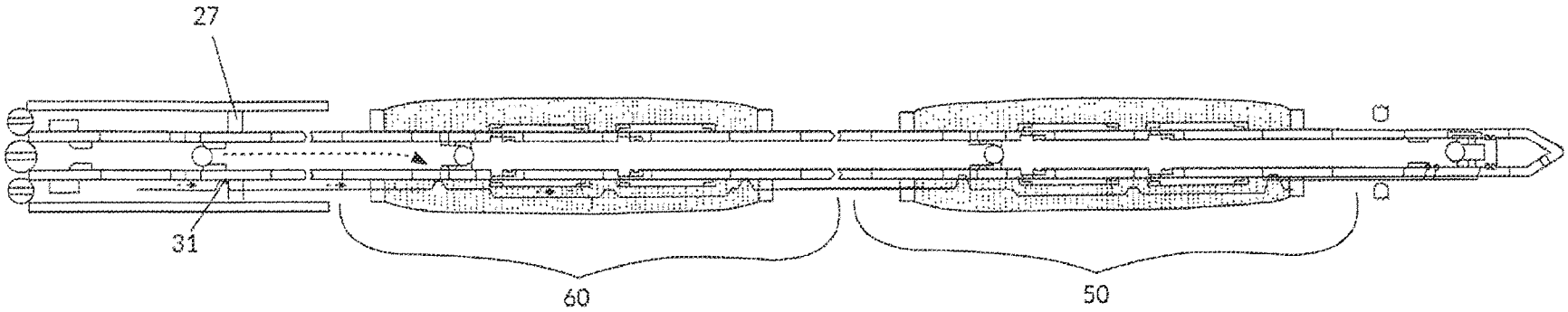
FIGS. 11A and 11B show an embodiment of an isolation phase of the multistage single trip completion system.
Figure 11B:
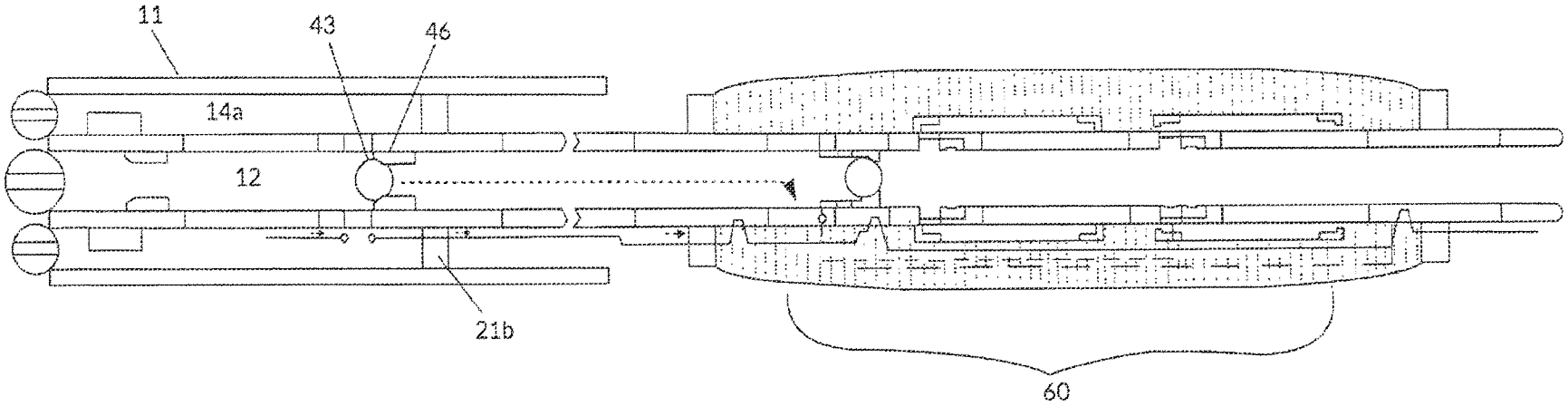

FIGS. 11A and 11B, collectively "FIG. 11", illustrate one embodiment of an isolation phase. In the embodiment of FIG. 11, an activation device 43 (e.g., a ball or other activation device) is conveyed to an activation device seat at the FT cased hole (production) packer 27. Pressure applied down the central bore 12 can result in a pressure differential across the seated activation device that is sufficient to shift the shift sleeve 46 and thereby open one or more circulating ports between the central bore 12 and the upper circulation tube 13*c*. Furthermore, shifting a shift sleeve 46 can shift a circulation tube isolation sleeve 19 to isolate the upper circulation tube 13*b* from lower circulation tubes 13*a*. At this point, the FT cased hole packer 21*b* is usable with a production packer with circulation ports 16 to allow circulation of fluids to, for example, underbalance the well.

Figure 12A:
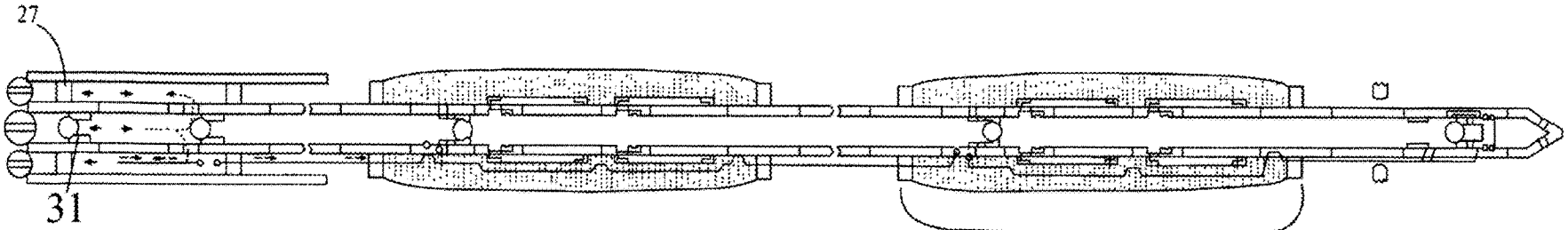
FIGS. 12A and 12B shows setting of a production packer.
Figure 12B:
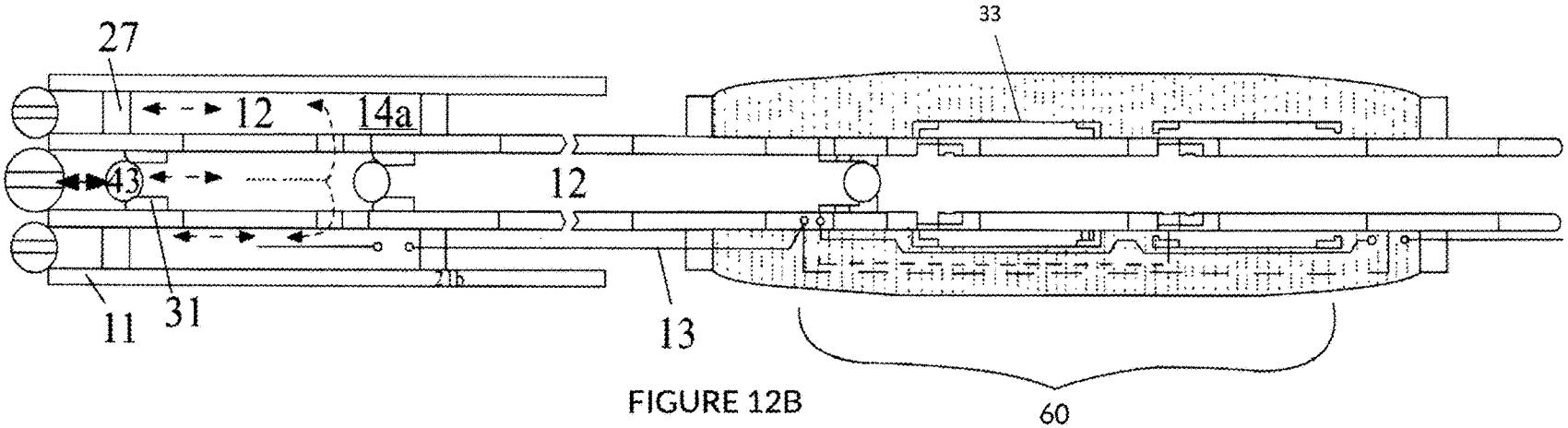

FIGS. 12A and 12B, collectively "FIG. 12", illustrate that the production packer 27 can be set using an activation device 43 as is known in the art.

As can be understood from the foregoing, a multi-zone completion system can be installed in a single trip. Moreover, various completion processes can be completed without requiring a service tool trip.

FIGS. 13A-13E show various configurations, and their corresponding flow paths as denoted by the dotted lines and arrows, that may be obtained with the multi-zone single trip completion system 10, which is illustrated in a slightly simplified manner.

Figure 13B:
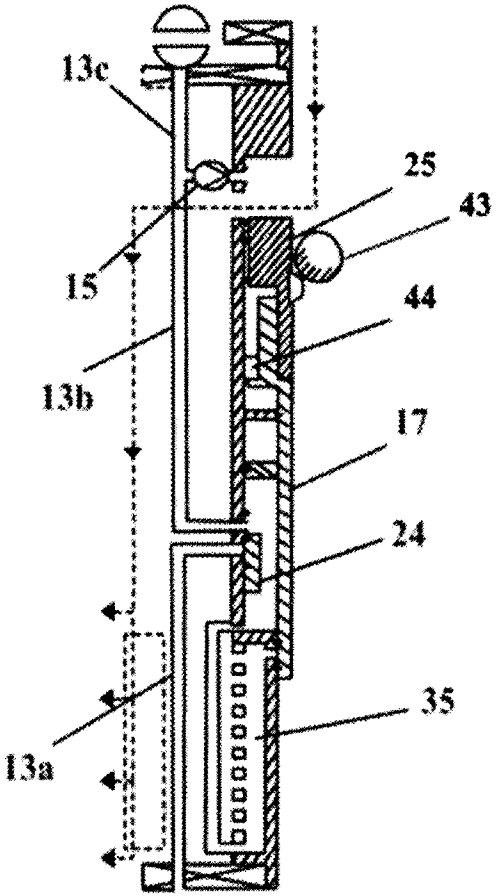
FIGS. 13A-13E illustrate various circulation system flow path configurations.
Figure 13A:
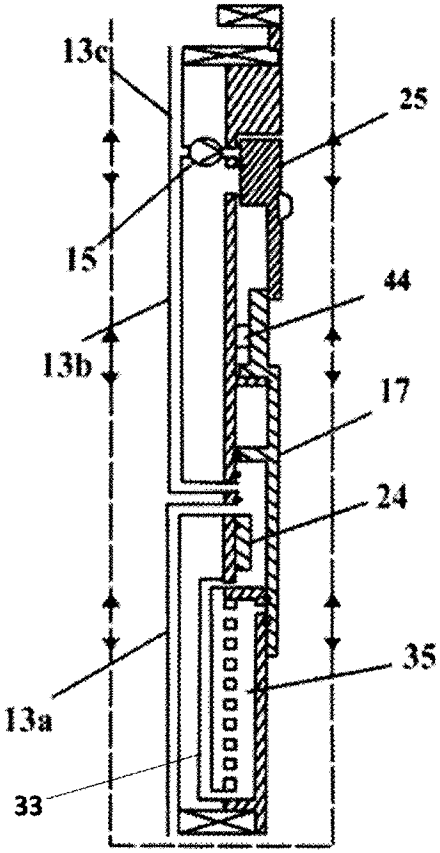

The multi-zone completion system 10 is run in a hole (RIH) for example, using a configuration as shown in FIG. 13A. FIG. 13A illustrates a portion of the circulation system 20, including a lower circulation tube 13*a*, a by-pass/dehydration tube 13*b* and an upper circulation tube 13*c*. The flow path is shown by the dotted lines, and the direction of flow, by the arrows. As seen, this flow path allows bidirectional flow of fluid, namely in both the direct and reverse directions. By-pass tube 13*b* moves the extra fluid, released from the gravel pack, uphole. This removal of extra fluid allows the gravel to be 'packed' and facilitates sand control by filtering the produced fluid during the production stage.

Circulation tubes provide an alternate fluid path to enable reverse circulation of fluids inside the wellbore. Reverse circulation helps recovering from screen-out conditions, by flushing the excess sand out from the wellbore.

A fracking sleeve 14 is actuated by ball-drop technique during the fracturing. Sleeve 17 in communication with fracking sleeve 25 is enabled to channel the flow of fluids during dehydration and production steps. A zone sleeve 24 controls or regulates fluid flow across multiple zones along the length of the circulation system 20. The zone sleeve 24 isolates other zones from the circulation flow path when a particular stage is being completed.

FIG. 13A also shows an inflow control device/screen 33 provided over the Inflow Control Devices (ICD) 35 for filtering unwanted particles from the production fluid and thus providing sand control during production stage. A dissolvable stop plug 44 that degrades after a set period of time, shifts the sleeves so that the production fluid can enter the central bore 12. The system may have a dissolvable ball seat as well. A check valve 15 (e.g. a fluid diode) directs the flow of fluids across various tubes/flow paths. The check valve 15 may be located in the circulation and de-hydration tubes.

FIG. 13B illustrates a stimulation path configuration. The flow of fluid is shown in dotted lines, the arrows providing the flow direction. During stimulation, a ball, plug or other activation device 43 is sent downhole to actuate the fracking sleeve 25 (note that the fracking sleeve moved down) and allow the fracking fluid to access the wellbore wall and start the fracturing process.

Figure 13D:
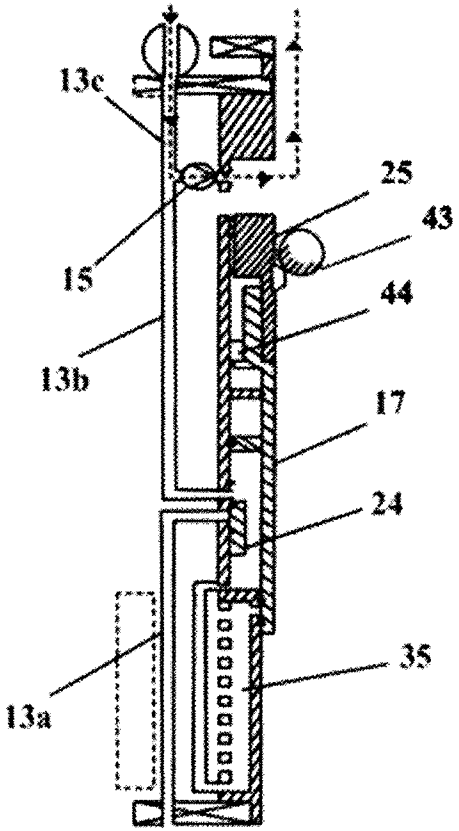
Figure 13C:
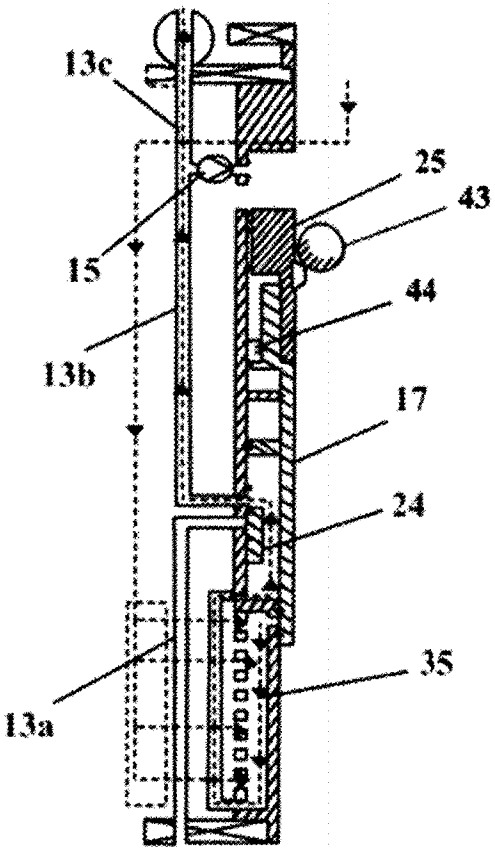

FIG. 13C shows a dehydration path configuration, where the flow of fluid is shown in dotted lines, and the arrows provide the flow direction. During dehydration, which takes place after fracking, gravel slurry is sent downhole from wellbore surface. The gravel particles are collected near the ICD 35 while the extra fluid is removed by using the dehydration tube 13*b*. This removal of extra fluid, or dehydration, is responsible for formation of a gravel pack at the same location. The service tools required in previous systems to perform dehydration are no longer required with the embodiment of the single trip completion system 10 shown in FIG. 13C.

FIG. 13D shows a reverse circulation path configuration, where the flow of fluid is shown in the dotted line, the arrows providing the flow direction. In this configuration, fluid is pumped from the surface via the upper circulation tube 13*c* to recover the system from a screen-out condition.

Figure 13E:
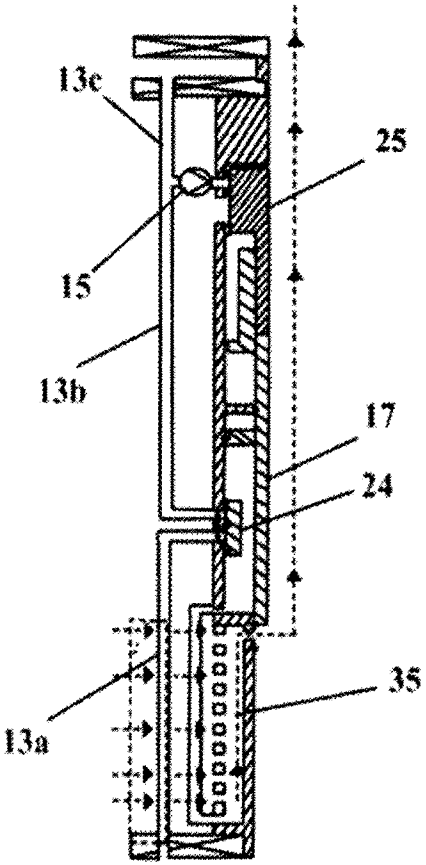

FIG. 13E illustrates a production path configuration. As in FIGS. 2A-2D, the flow of fluid is shown in the dotted line, the arrows providing the flow direction. It is to be noted that the dissolvable stop plug 44 has dissolved by the time production fluids are released post fracking. This causes the control sleeve to move up and allow production fluids into the central bore 12. As seen, the production fluid gets filtered by the gravel pack and the ICDs 35 before entering the central bore 12.

As used herein, the terms "comprises," "comprising," "includes," "including," "has," "having" or any other variation thereof, are intended to cover a non-exclusive inclusion. For example, a process, product, article, or apparatus that comprises a list of elements is not necessarily limited only to those elements but may include other elements not expressly listed or inherent to such process, product, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

Additionally, any examples or illustrations given herein (including in any Appendix) are not to be regarded in any way as restrictions on, limits to, or express definitions of, any term or terms with which they are utilized. Instead, these examples or illustrations are to be regarded as being described with respect to one particular embodiment and as illustrative only. Those of ordinary skill in the art will appreciate that any term or terms with which these examples or illustrations are utilized will encompass other embodiments which may or may not be given therewith or elsewhere in the specification and all such embodiments are intended to be included within the scope of that term or terms. Language designating such nonlimiting examples and illustrations includes, but is not limited to: "for example," "for instance," "e.g.," "in one embodiment."

Benefits, other advantages, and solutions to problems have been described above with regard to specific embodiments. However, the benefits, advantages, solutions to problems, and any component(s) that may cause any benefit, advantage, or solution to occur or become more pronounced are not to be construed as a critical, required, or essential feature or component.

Reference throughout this specification to "one embodiment", "an embodiment", or "a specific embodiment" or similar terminology means that a particular feature, structure, or characteristic described in connection with the embodiment is included in at least one embodiment and may not necessarily be present in all embodiments. Thus, respective appearances of the phrases "in one embodiment", "in an embodiment", or "in a specific embodiment" or similar terminology in various places throughout this specification are not necessarily referring to the same embodiment. Furthermore, the particular features, structures, or characteristics of any particular embodiment may be combined in any suitable manner with one or more other embodiments. It is to be understood that other variations and modifications of the embodiments described and illustrated herein are possible in light of the teachings herein and are to be considered as part of the spirit and scope of the invention.

In the description herein, numerous specific details are provided, such as examples of components and/or methods, to provide a thorough understanding of embodiments of the invention. One skilled in the relevant art will recognize, however, that an embodiment may be able to be practiced without one or more of the specific details, or with other apparatus, systems, assemblies, methods, components, materials, parts, and/or the like. In other instances, well-known structures, components, systems, materials, or operations are not specifically shown or described in detail to avoid obscuring aspects of embodiments of the invention. While the invention may be illustrated by using a particular embodiment, this is not and does not limit the invention to any particular embodiment and a person of ordinary skill in the art will recognize that additional embodiments are readily understandable and are a part of this invention.

Although the invention has been described with respect to specific embodiments thereof, these embodiments are merely illustrative, and not restrictive of the invention. Rather, the description is intended to describe illustrative embodiments, features and functions in order to provide a person of ordinary skill in the art context to understand the invention without limiting the invention to any particularly described embodiment, feature or function. While specific embodiments of, and examples for, the invention are described herein for illustrative purposes only, various equivalent modifications are possible within the spirit and scope of the invention, as those skilled in the relevant art will recognize and appreciate. As indicated, these modifications may be made to the invention in light of the foregoing description of illustrated embodiments of the invention and are to be included within the spirit and scope of the invention. Thus, while the invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the invention.

What is claimed is:

1. A method of operating a multizone single trip completion system, comprising:

installing a tubing string in a wellbore, defining a borehole annulus between the tubing string and the wellbore, the tubing string having a central bore and a plurality of sections, providing each a section being with a selectively openable stimulation port assembly and a selectively openable production port assembly;

isolating a plurality of zones along the borehole annulus using isolation packers, a respective zone being associated with a corresponding section positioned adjacent to the respective zone;

installing along the tubing string a circulation system comprising a plurality of circulation tubes with circulation ports and circulation tube valves;

providing isolation valves to separate the circulation system into segments, each segment being associated with the respective zone;

providing in the borehole annulus, along the tubing string, a circulation control line adapted to configure the circulation system in a selected configuration; and providing in the borehole annulus, along the tubing string, a production control line adapted to configure the production port assembly and the stimulation port assembly in the selected configuration; and operating the multizone single trip completion system in the selected configuration.

2. The method of claim 1, wherein operating the multizone single trip completion system in the selected configuration comprises configuring the circulation ports and circulation tube valves over the circulation control line, to create a circulation flow path to pump an activation device.

3. The method of claim 1, wherein operating the multizone single trip completion system in the selected configuration comprises configuring the circulation ports and circulation tube valves over the circulation control line, to create a circulation flow path to route fluids into the annulus to dehydrate a pack.

4. The method of claim 1, wherein operating the multizone single trip completion system in the selected configuration comprises configuring the circulation ports and circulation tube valves over the circulation control line, to create a dehydration circulation flow path to apply pressure down the central bore or annulus.

5. The method of claim 1, wherein operating the multizone single trip completion system in the selected configuration comprises configuring the circulation ports and circulation tube valves over the circulation control line, to create a circulation path to reverse-out excess fluid.

6. The method of claim 1, wherein operating the multizone single trip completion system in the selected configuration comprises configuring the circulation ports and circulation tube valves over the circulation control line, to create a circulation path that maintains zonal isolation.

7. The method of claim 1, wherein operating the multizone single trip completion system in the selected configuration comprises configuring the circulation ports and circulation tube valves over the circulation control line, to provide selective access to different zones for multi-zone gravel packing and completion.

8. The method of claim 1, wherein operating the multizone single trip completion system in the selected configuration comprises configuring the production port assembly and the stimulation port assembly over the production control line.

9. The method of claim 1 wherein operating the multizone single trip completion system in the selected configuration comprises selectively connecting, via a circulation flow path, the central bore or the borehole annulus at each of the plurality of sections, to an upper circulation flow path open to an annulus above an uppermost of the isolation packers.

10. The method of claim 1 wherein operating the multizone single trip completion system in the selected configuration comprises selectively isolating the circulation tubes below an isolation valve of the isolation valves from the circulation tubes above said isolation valve.

11. The method of claim 10, wherein operating the multizone single trip completion system in the selected configuration comprises positioning a circulation tube of the circulation tubes below the isolation valve to enable to isolate the circulation tubes at, and above the respective zone from circulation tubes below the respective zone.

12. The method of claim 11, wherein positioning the isolation valve comprises incorporating the isolation valve in a packer at a lower side of the respective zone to close off a circulation flow path proximate to that packer.

13. The method of claim 1, wherein operating the multizone single trip completion system comprises configuring the multizone completion system in a run-in configuration, a stimulation configuration, a dehydration configuration, and a reverse circulation configuration, without intervention of a service tool.

14. The method of claim 1, wherein operating the multizone single trip completion system comprises providing a circulation flow path adapted to enable pumping down an activation device through the central bore without bullheading fluids into the borehole annulus.

15. The method of claim 13, wherein in the dehydration configuration, a circulation flow path provides a dehydration flow path for dehydrating a gravel pack without using service tools.

16. The method of claim 13, wherein in the circulation system is configurable to reverse-out excess fluid.

17. The method of claim 13, further comprising configuring the circulation system to provide a live annulus.

18. The method of claim 1, wherein operating the multizone single trip completion system in the selected configuration is performed without a service tool run from surface.

* * * * *